US009951431B2

(12) United States Patent
Jackson et al.

(10) Patent No.: US 9,951,431 B2
(45) Date of Patent: Apr. 24, 2018

(54) ELECTROCATALYTIC HYDROGENATION AND HYDRODEOXYGENATION OF OXYGENATED AND UNSATURATED ORGANIC COMPOUNDS

(71) Applicant: BOARD OF TRUSTEES OF MICHIGAN STATE UNIVERSITY, East Lansing, MI (US)

(72) Inventors: James E. Jackson, Haslett, MI (US); Chun Ho Lam, East Lansing, MI (US); Christopher M. Saffron, Okemos, MI (US); Dennis J. Miller, Okemos, MI (US)

(73) Assignee: BOARD OF TRUSTEES OF MICHIGAN STATE UNIVERSITY, East Lansing, MI (US)

( * ) Notice: Subject to any disclaimer, the term of this patent is extended or adjusted under 35 U.S.C. 154(b) by 269 days.

(21) Appl. No.: 14/061,460

(22) Filed: Oct. 23, 2013

(65) Prior Publication Data

US 2014/0110268 A1 Apr. 24, 2014

Related U.S. Application Data

(60) Provisional application No. 61/717,804, filed on Oct. 24, 2012.

(51) Int. Cl.

| | |
|---|---|
| ***C25B 3/04*** | (2006.01) |
| ***C25B 11/04*** | (2006.01) |
| ***C25B 9/00*** | (2006.01) |

(52) U.S. Cl.

CPC ..... *C25B 3/04* (2013.01); *C25B 9/00* (2013.01); *C25B 11/0415* (2013.01); *C25B 11/0442* (2013.01)

(58) Field of Classification Search

None

See application file for complete search history.

(56) References Cited

U.S. PATENT DOCUMENTS 4,547,273 A * 10/1985 Ayers ..... 205/440
4,584,069 A 4/1986 Lessard et al.

(Continued)

FOREIGN PATENT DOCUMENTS

WO WO-2013/134220 A1 9/2013

OTHER PUBLICATIONS

Laplante et al, Considreations about phenol electrohydrogenation on electrodes made with reticulated vitreous carbon cathode, Canadian Jounral of Chemistry, vol. 81, No. 3, pp. 258-264, Mar. 2003.*

(Continued)

*Primary Examiner* — Harry D Wilkins, III

(74) *Attorney, Agent, or Firm* — Marshall, Gerstein & Borun LLP

(57) ABSTRACT

A process and related electrode composition are disclosed for the electrocatalytic hydrogenation and/or hydrodeoxygenation of organic substrates such as biomass-derived bio-oil components by the production of hydrogen atoms on a catalyst surface followed by the reaction of the hydrogen atoms with the organic reactants. Biomass fast pyrolysis-derived bio-oil is a liquid mixture containing hundreds of organic compounds with chemical functionalities that are corrosive to container materials and are prone to polymerization. A high surface area skeletal metal catalyst material such as Raney Nickel can be used as the cathode. Electrocatalytic hydrogenation and/or hydrodeoxygenation convert the organic substrates under mild conditions to reduce coke formation and catalyst deactivation. The process converts oxygen-containing functionalities and unsaturated bonds into chemically reduced forms with an increased hydrogen (Continued)

content. The process is operated at mild conditions, which enables it to be a good means for stabilizing bio-oil to a form that can be stored and transported using metal containers and pipes.

30 Claims, 4 Drawing Sheets

(56) References Cited

U.S. PATENT DOCUMENTS

| | | | | |
|---|---|---|---|---|
| 5,141,604 | A * | 8/1992 | Ayers | 205/637 |
| 5,225,581 | A * | 7/1993 | Pintauro | 554/147 |
| 5,919,349 | A | 7/1999 | Huber et al. | |
| 5,959,167 | A | 9/1999 | Shabtai et al. | |
| 6,218,556 | B1 * | 4/2001 | Pintauro | 554/124 |
| 7,425,657 | B1 | 9/2008 | Elliott et al. | |
| 8,217,211 | B2 | 7/2012 | Agrawal et al. | |
| 2003/0213700 | A1 * | 11/2003 | Lalvani et al. | 205/441 |
| 2011/0042229 | A1 * | 2/2011 | Fan | 205/413 |

OTHER PUBLICATIONS

Hu et al, Final Report: Investigation of Catalytic Pathways for Lignin Breakdown into Monomers and Fuels, ResearchGate, publicly available at http://www.researchgate.net/publication/241964857, Oct. 2010.*

Kanan et al, Cobalt-phosphate oxygen-evolving compound, Chemical Society Reviews, vol. 38, No. 1, Nov. 2008, pp. 109-114.*

Joshi et al, Hydrodeoxygenation of pyrolysis oil in a microreactor, Chemical Engineering Science, vol. 74, No. 1, Feb. 2012, pp. 1-8.*

Smith et al, The Preparation of Skeletal Catalysts, Annual Review of Materials Research, vol. 35, Mar. 2005 pp. 127-142.*

Lessard, Jean, "2004 Murray Raney Award: Electrocatalytic Hydrogenation of Organic Compounds at Raney Metal Electrodes: Scope and Limitations", from Catalysis of Organic Reactions, edited by Sowa, Jr., John R., 2005 (no month available), pp. 3-17.*

Robin et al, "The electrocatalytic hydrogenation of fused polycyclic aromatic compounds at Raney nickel electrodes: the influence of catalyst activation and electrolysis conditions", Canadian Journal of Chemistry, vol. 68, No. 7, Jul. 1990, pp. 1218-1227.*

Mahdavi et al, Electrocatalytic hydrogenation of conjugated enones on nickel boride, nickel, and Raney nickel electrodes, Canadian Journal of Chemistry, vol. 73, No. 6, Jun. 1995, pp. 846-852.*

Li et al, Mild electrocatalytic hydrogenation and hydrodeoxygenation of bio-oil derived phenolic compounds using ruthenium supported on activated carbon cloth, Green Chemistry, vol. 14, No. 9, Jun. 2012, pp. 2540-2549.*

930-68-7, Chemical Book, obtained at https://www.chemicalbook.com/CASEN_930-68-7.htm, accessed on Aug. 17, 2017 (Year: 2017).*

Belot G., Desjardins S., and Lessard J., "Electrocatalytic Hydrogenation of Organic Compounds on Devarda Copper and Raney Nickel Electrodes in Basic Media," *Tetrahedron Letters*, 25(47):5347-50 (1984).

Bridgwater A.V., "Review of Fast Pyrolysis of Biomass and Product Upgrading," *Biomass and Bioenergy*, 38:68-94 (2012).

Bui V.N., Laurenti D., Afanasiev P., and Geantet C., "Hydrodeoxygenation of Guaiacol with CoMo Catalysts. Part I: Promoting Effect of Cobalt on HDO Selectivity and Activity," *Applied Catalysis B: Environmental*, 101:239-45 (2011).

Chambrion P., Roger L., Lessard J., Béraud V., Mailhot J., and Thomalla M., "The Influence of Surfactants on the Electrocatalytic Hydrogenation of Organic Compounds in Micellar, Emulsified, and Hydroorganic Solutions at Raney Nickel Electrodes," *Can. J. Chem.*, 73:804-15 (1995).

Choudhary T.V., and Phillip C.B., "Renewable Fuels Via Catalytic Hydrodeoxygenation," *Applied Catalysis A: General*, 397:1-12 (2011).

Cyr A., Chiltz F., Jeanson P., Martel A., Brossard L., Lessard J., and Ménard H., "Electrocatalytic Hydrogenation of Lignin Models at Raney Nickel and Palladium-Based Electrodes," *Can. J. Chem.*, 78:307-15 (2000).

Czernik S., and Bridgwater A.V., "Overview of Applications of Biomass Fast Pyrolysis Oil," *Energy & Fuels*, 18:590-98 (2004).

Dabo P., Cyr A., Lessard J., Brossard L., and Ménard H., "Electrocatalytic Hydrogenation of 4-Phenoxyphenol on Active Powders Highly Dispersed in a Reticulated Vitreous Carbon Electrode," *Can. J. Chem.*, 77:1225-29 (1999).

Elliott D.C., "Historical Developments in Hydroprocessing Bio-Oils," *Energy & Fuels*, 21:1792-1815 (2007).

Elliott D.C., "Catalytic Hydroprocessing of Chemical Models for Bio-Oil," *Energy & Fuels*, 23:631-37 (2009).

Furimsky E., "Catalytic Hydrodeoxygenation," *Applied Catalysis A: General*, 199:147-90 (2000).

Ilikti H., Rekik N., and Thomalla M., "Electrocatalytic Hydrogenation of Phenol in Aqueous Solutions at a Raney Nickel Electrode in the Presence of Cationic Surfactants," *J. Appl. Electrochem.*, 32:603-09 (2002).

Ilikti H., Rekik N., and Thomalla M., "Electrocatalytic Hydrogenation of Alkyl-Substituted Phenols in Aqueous Solutions at a Raney Nickel Electrode in the Presence of a Non-Micelle-Forming Cationic Surfactant," *J. Appl. Electrochem.*, 34:127-36 (2004).

Kanan M.W., and Nocera D.G., "In Situ Formation of an Oxygen-Evolving Catalyst in Neutral Water Containing Phosphate and $Co^{2+}$," *Science*, 321:1072 (2008).

Kelley P., Lin S., Edouard G., Day M.W., and Agapie T., "Nickel-Mediated Hydrogenolysis of C—O Bonds of Aryl Ethers: What is the Source of the Hydrogen," *J. Am. Chem. Soc.* 134:5480-83 (2012).

Mahdavi B., LaFrance A., Martel A., Lessard J., and Ménard H., "Electrocatalytic Hydrogenolysis of Lignin Model Dimers at Raney Nickel Electrodes," *J. Appl. Electrochem.*, 27:605-11 (1997).

Mortensen P.M., Grunwaldt J.D., Jensen P.A., Knudsen K.G., Jensen A.D., "A Review of Catalytic Upgrading of Bio-Oil to Engine Fuels," *Applied Catalysis A: General*, 407:1-19 (2011).

Robin D., Comtois M., Martel A., Lemieux R., Cheong A.K., Belot G., and Lessard J., "The Electrocatalytic Hydrogenation of Fused Polycyclic Aromatic Compounds at Raney Nickel Electrodes: The Influence of Catalyst Activation and Electrolysis Conditions," *Can. J. Chem.*, 68:1218 (1990).

Sergeev A.G. et al., "Selective, Nickel-Catalyzed Hydrogenolysis of Aryl Ethers," *Science*, 332:439 (2011).

Tobisu M., and Chatani N., Catalytic Hydrogenolysis of C—O Bonds in Aryl Ethers, *ChemCatChem*, 3:1410-11 (2011).

Wildschut J., Mahfud F.H., Venderbosch R.H., and Heeres H.J., "Hydrotreatment of Fast Pyrolysis Oil Using Heterogeneous Noble-Metal Catalysts," *Ind. Eng. Chem.* Res., 48:10324-34 (2009).

Zhao C., Kou Y., Lemonidou A.A., Li X., and Lercher J.A., Highly Selective Catalytic Conversion of Phenolic Bio-Oil to Alkanes, *Angew. Chem. Int. Ed.*, 48:3987-90 (2009).

Zhao C., Kou Y., Lemonidou A.A., Li X., and Lercher J.A., "Hydrodeoxygenation of Bio-Derived Phenols to Hydrocarbons Using RANEY® Ni and Nafion/$SiO_2$ Catalysts," *Chem. Commun.*, 46:412-14 (2010).

* cited by examiner

ELECTROCATALYTIC HYDROGENATION AND HYDRODEOXYGENATION OF OXYGENATED AND UNSATURATED ORGANIC COMPOUNDS

CROSS REFERENCE TO RELATED APPLICATION

Priority is claimed to U.S. Provisional Application No. 61/717,804 (filed on Oct. 24, 2012), which is incorporated herein by reference in its entirety.

STATEMENT OF GOVERNMENT INTEREST

This invention was made with government support under DE-FG36-04GO14216 awarded by the United States Department of Energy. The government has certain rights in the invention.

BACKGROUND OF THE DISCLOSURE

Field of the Disclosure

The disclosure generally relates to a process for the electrocatalytic hydrogenation and/or hydrodeoxygenation of biomass-derived bio-oil or other related organic compounds by the production of hydrogen atoms on a catalyst surface followed by the reaction of the hydrogen atoms with the organic compounds in bio-oil, wherein the catalyst is a porous, high surface area metal material such as a skeletal metal catalyst.

Brief Description of Related Technology

Biomass fast pyrolysis-derived bio-oil is a liquid mixture containing hundreds of organic compounds with chemical functionalities that are corrosive to container materials and are prone to polymerization. After aging during storage or transit, the properties of bio-oil change which renders the mixture incompatible with the existing U.S. energy infrastructure. Stabilization and upgrading of the bio-oil into a more stable form is required.

SUMMARY

The disclosure relates to electrocatalytic hydrogenation (ECH) and/or electrocatalytic hydrodeoxygenation (ECHDO) of an organic substrate/reactant, which can stabilize bio-oil (e.g., as an illustrative multicomponent organic reactant) at low temperature and pressure (e.g., less than 100° C., even room temperature, and ambient pressure). The process can increase the specific energy (MJ/kg) of the stabilized organic hydrocarbon material. Electrocatalytic hydrogenation is used to convert oxygen-containing functionalities and unsaturated carbon-carbon bonds into chemically reduced forms with an increased hydrogen content and reduced reactivity. Lower temperature results in reduced coke encapsulation of the embedded catalyst, and hence, reduced catalyst deactivation. The use of mild operating conditions (e.g., at atmospheric pressure and below the boiling point of the medium (typically water with or without electrolyte salts)) provides a good means for stabilizing bio-oils to a form that can be stored and transported using metal containers and pipes. The use of mild operating conditions also avoids bio-oil decomposition into small molecules and thus retains more carbon in the final liquid products. The stabilization and energy upgrading extend to full hydrogenation and deoxygenation, potentially serving as a main refining path from biomass-derived liquids to fuel and chemical-grade hydrocarbons and oxygenates.

The present disclosure relates to electrocatalytic stabilization and energy upgrading of bio-oil or other organic reactant(s) by bypassing conventional hydrogenation with hydrogen gas. A general process for the treatment of oxygenated and/or unsaturated organic compound reactants incorporates a skeletal metal catalyst such as Raney Nickel to catalyze the ECH and/or ECHDO of one or more organic reactants (e.g., as a bio-oil mixture or otherwise). This eliminates the use of hydrogen gas and high pressures, and is thus safer and less equipment intensive. Electrocatalysis only requires access to local power grids to supply the needed electricity to promote chemical reduction. The electricity can be generated from alternative renewable sources, such as solar, wind, hydro, etc., which makes electrocatalytic upgrading of a bio-oil feedstock more sustainable. As noted above, its mild conditions of operation, the low costs of the catalytic materials, and the energy upgrading aspect may enable such technologies to couple biomass conversion to the reactions and products that today are associated with refining of petroleum.

A common drawback of ECH is the material and electrical cost of conventional water-oxidizing anodes, which typically require a high overpotential noble metal, such as platinum, to avoid corrosion. A cobalt phosphate water oxidation catalyst, supported on a stainless steel grid, provides a convenient, inexpensive alternative. This robust self-assembled catalyst maintains activity via dynamic dissolution and redeposition, and it operates for many hours with no signs of physical degradation or activity loss.

Raney Nickel (Ra—Ni) is a low cost metal catalyst that is active and efficient for aromatic ring hydrogenation. It is also readily deposited on electrode surfaces via electroplating. Earlier electrochemical studies have shown that Ra—Ni can break down model lignin oligomers into smaller fragments and may further hydrogenate them, depending on conditions.

As illustrated in the examples below, aromatic model compounds (e.g., guaiacol, phenol, syringol, which are representative of bio-oil constituents that are relatively difficult to reduce/upgrade/stabilize for energy purposes) can be hydrogenated to a more chemically reduced form with a Raney-Nickel cathode while using a cobalt phosphate catalyst for water oxidation at the anode. The results show that ECH can be achieved in the absence of noble metals such as platinum, indium, or other precious metals that are conventionally used as electrodes (e.g., anode and/or cathode including metals such as Ag, Au, Ir, Os, Pd, Rh, or Ru). Time-course studies show that reaction performance is maintained for at least 16 hours.

In one aspect, the disclosure relates to a process for performing at least one of electrocatalytic hydrogenation (ECH) and electrocatalytic hydrodeoxygenation (ECHDO) of an organic substrate, the process comprising: (a) providing a reaction mixture comprising an organic reactant comprising one or more functional groups selected from the group consisting of carbonyl carbon-oxygen double bonds, aromatic double bonds, (ethylenic) carbon-carbon double bonds, (acetylenic) carbon-carbon triple bonds, hydroxyl carbon-oxygen single bonds, ether carbon-oxygen single bonds, and combinations thereof; (b) contacting the reaction mixture with a first electrode (e.g., a cathode) and a catalytic composition comprising a skeletal (e.g., Raney) metal catalyst capable of catalyzing at least one of electrocatalytic hydrogenation (ECH) and electrocatalytic hydrodeoxygenation (ECHDO); (c) electrically contacting the reaction mixture with a second electrode (e.g., an anode); (d) applying an electrical potential between the first electrode and the second electrode to provide an electrical current therebetween and through the reaction mixture, thereby performing at least one of an ECH reaction and an ECHDO reaction to reduce or deoxygenate at least one of the functional groups of the organic reactant and to form at least one of (i) an ECH reaction product thereof and (ii) an ECHDO reaction product thereof; and optionally (e) recovering or separating the reaction product from the reaction mixture; wherein the reaction mixture has a pH value ranging from 4 to 11 when applying the electrical potential to form the reaction product. In various embodiments, the pH value of the reaction mixture is at least 4, 5, 6, 7, or 8 and/or up to 7, 8, 9, 10, or 11. For example, the reaction mixture can have an initial pH value ranging from 4 to 11 (or a sub-range thereof as above) and is maintained in the range from 4 to 11 (or a sub-range thereof) during the application of the electrical potential to form the reaction product. To this end, the reaction mixture can further comprise a pH buffer to maintain the pH value of the reaction mixture in a selected range during the application of the electrical potential to form the reaction product.

In another aspect, the disclosure relates to a process for performing at least one of electrocatalytic hydrogenation (ECH) and electrocatalytic hydrodeoxygenation (ECHDO) of an organic substrate, the process comprising: (a) providing a reaction mixture comprising a plurality of organic reactants, wherein: (i) the plurality of organic reactants is selected from the group consisting of a multicomponent bio-oil, a multicomponent bio-oil fraction, a plurality of bio-oil components, and combinations thereof, and (ii) the organic reactants collectively comprise one or more functional groups selected from the group consisting of carbonyl carbon-oxygen double bonds, aromatic double bonds, (ethylenic) carbon-carbon double bonds, (acetylenic) carbon-carbon triple bonds, hydroxyl carbon-oxygen single bonds, ether carbon-oxygen single bonds, and combinations thereof; (b) contacting the reaction mixture with a first electrode (e.g., a cathode) and a catalytic composition comprising a skeletal (e.g., Raney) metal catalyst capable of catalyzing at least one of electrocatalytic hydrogenation (ECH) and electrocatalytic hydrodeoxygenation (ECHDO); (c) electrically contacting the reaction mixture with a second electrode (e.g., an anode); (d) applying an electrical potential between the first electrode and the second electrode to provide an electrical current therebetween and through the reaction mixture, thereby performing at least one of an ECH reaction and an ECHDO reaction to reduce or deoxygenate at least one of the functional groups of the organic reactants and to form at least one of (i) an ECH reaction product thereof and (ii) an ECHDO reaction product thereof; and optionally (e) recovering or separating the reaction product from the reaction mixture. In various embodiments, the pH value of the reaction mixture can be at least 2, 3, 4, 5, 6, 7 or 8 and/or up to 7, 8, 9, 10, or 11 (e.g., representing an initial pH value and/or a pH value/range during reaction, such as where the reaction mixture further comprises a pH buffer to maintain the pH value of the reaction mixture in a selected range during the application of the electrical potential to form the reaction product).

Various refinements and extensions of the foregoing ECH and ECHDO processes are possible.

For example, with respect the skeletal metal catalyst, the metal of the skeletal metal catalyst is selected from the group consisting of Ru, Ni, Fe, Cu, Pt, Pd, Rh, Ir, Re, Os, Ag, Au, Co, Mo, Ga, Ti, Mn, Zn, V, Cr, W, Sn, mixtures thereof, alloys thereof, and combinations thereof. In a refinement, the metal of the skeletal metal catalyst comprises at least one of Ni and a Ni-containing alloy. In another refinement, the skeletal metal catalyst comprises an alkaline leaching product of an alloy comprising (i) aluminum (e.g., alone or in combination with one or more promoter metals such as zinc or chromium) and (ii) the metal of the skeletal metal catalyst (e.g., nickel). The skeletal metal catalyst suitably has a microporous structure with a specific BET surface area of at least 5 $m^2/g$ or 10 $m^2/g$ and/or up to 20 $m^2/g$, 40 $m^2/g$, 60 $m^2/g$, or 100 $m^2/g$. In an embodiment, the catalytic composition is immobilized on the first electrode (e.g., in a configuration where a stainless steel or other conductive first electrode material serves as a support for the skeletal (Raney) metal catalyst as illustrated in the examples). For example, the catalyst composition can comprise an alkaline leaching product of a composite material comprising (i) a metal matrix and (ii) an alloy comprising (A) aluminum and (B) the metal of the skeletal metal catalyst. The alloy can be in the form of alloy particles embedded in the metal matrix during deposition of the matrix on a support/electrode material (e.g., embedded alloy particles completely surrounded by the metal matrix before leaching, and/or embedded alloy particles having at least some exposed surface area for initial contact with the leaching solution). The metal matrix is generally non-catalytic and can be the same or different metal(s) as the metal(s) of the skeletal metal catalyst. In other illustrative embodiments, (i) the catalytic composition can be a freely suspended skeletal metal catalyst (e.g., particles thereof suspended in the reaction medium) within a porous electrode material (e.g., reticulated vitreous carbon), or (ii) the catalytic composition can be a composite material formed from a metal and a skeletal metal alloy that serves as both the electrode and the catalytic composition.

With respect the second electrode (anode), the second electrode can comprise an electrically conductive material selected from the group consisting of stainless steel, silver, nickel, platinum, carbon, lead, lead dioxide, indium tin oxide, mixtures thereof, alloys thereof, and combinations thereof. In a refinement, the second electrode comprises cobalt(III) phosphate (e.g., $CoPO_4$ deposited on an electrode support such as stainless steel as the cobalt phosphate (Co—P) electrode).

The disclosed processes can obtain substantially high conversion levels of the organic reactants, generally in combination with a correspondingly high degree of selectivity toward the desired reaction product (e.g., the ECH or ECHDO reaction product; without substantial formation of $H_2$ as an undesired reaction product; on a molar or mass basis). For example, the organic reactant can have a conversion and/or selectivity toward the desired product of at least 80%, 85%, 90%, 95%, 98%, or 99% (e.g., one or more organic reactants individually; all organic reactants collectively). Similarly, the organic reactant can have a selectivity toward one or more undesired products of 20%, 15%, 10%, 5%, 2%, or 1% or less. In a refinement, the organic reactant comprises the aromatic double bonds and at least 80%, 85%, 90%, 95%, 98%, or 99% of the aromatic double bonds are hydrogenated via ECH in the ECH reaction product (e.g., where the percentages additionally can represent the degree of saturation on a number/molar basis for aromatic groups in the organic reactant, whether as individual aromatic double bonds or whole aromatic groups). In another refinement, the organic reactant comprises the ether carbon-oxygen single bonds and at least 80%, 85%, 90%, 95%, 98%, or 99% of the ether carbon-oxygen single bonds are cleaved via ECHDO in the ECHDO reaction product (e.g., where the percentages additionally can represent the conversion of a reactant having alkoxy groups to a corresponding de-alkoxylated product and/or an alcohol, in particular where the reactant is an alkoxyaromatic with other substituents (e.g., oxygen-containing substituents such as phenolic —OH groups) and the aromatic portion of the reactant is also saturated with the high degrees of conversion). In another embodiment, the process exhibits high reactant carbon recovery, with the ECH or ECHDO reaction product containing at least 80%, 85%, or 90% and/or up to 90%, 95%, or 98% of the carbon initially contained in the reaction mixture.

The disclosed processes are applicable to a broad range of organic reactants/substrates. In various embodiments, the catalyst composition is capable of catalyzing at least one of (i) ECH of unsaturated carbon-carbon bonds in an organic substrate, (ii) ECH of carbon-oxygen double bonds in an organic substrate, and/or (iii) ECHDO of carbon-oxygen single bonds in an organic substrate. For example, the carbonyl carbon-oxygen double bonds subject to ECH/ECHDO can be present in a functional group selected from the group consisting of ketone groups, aldehyde groups, carboxylic acid groups, ester groups, amide groups, enone groups, acyl halide groups, acid anhydride groups, and combinations thereof. The aromatic double bonds subject to ECH/ECHDO can be carbon-carbon aromatic double bonds or carbon-heteroatom double bonds (e.g., such as C with N, O, or S in a heteroaromatic functional group). Such aromatic double bonds can be present in a functional group selected from the group consisting of benzenes, phenols, furans, pyridines, pyrazines, imidazoles, pyrazoles, oxazoles, thiophenes, naphthalenes, higher fused aromatics (e.g., with three or more fused aromatic rings), and combinations thereof. In such cases, the functional group can be the compound itself (such as phenol being reduced to cyclohexanone) or a substituted derivative of the compound (such as guaiacol being reduced to phenol).

As an example of a specific functional group amenable to electrocatalytic treatment, the functional group can comprise a C═O group, and the corresponding ECH reaction product can comprise at least one of a C—OH group (e.g., a CH—OH group) and a $CH_2$ group (e.g., for ECH followed by ECHDO of the intermediate hydroxy group). In another embodiment, the functional group can comprise an aromatic CH group, and the corresponding ECH reaction product can comprise a $CH_2$ group (e.g., in a reduced cyclic reaction product). In another embodiment, the functional group can comprise an ethylenic C═C group, and the corresponding ECH reaction product can comprise a CH—CH group. In another embodiment, the functional group can comprise a C—OH group, and the corresponding ECHDO reaction product can comprise a CH group (e.g., a deoxygenated alcohol/hydroxyl group). In another embodiment, the functional group can comprise a C—OR group, and the corresponding ECHDO reaction product can comprise a CH group (e.g., a deoxygenated alkoxy group where R is an alkyl group (such as with 1 to 10 carbon atoms); including ROH as an additional alcohol reaction product). In another embodiment, the functional group can comprise a (C═O)O group, and the corresponding ECHDO reaction product can comprise at least one of a (C═O)H group and a C—OH group (e.g., a carboxylate group (such as in a carboxylic acid) which is deoxygenated or reduced to form a corresponding aldehyde and/or alcohol, for example including a —$CH_2$OH group); such as may take place at reaction temperatures above about 70° C.). In another embodiment, the functional group can comprise an ether $R_1$—O—$R_2$ group, and the corresponding ECH or ECHDO reaction products can comprise one or more of a $R_1$H, $R_2$OH, $R_1$OH, and $R_2$H, where $R_1$ and $R_2$ are substituents containing from 1 to 10 carbon atoms (e.g., $R_1$ and $R_2$ can be organic or hydrocarbon substituents having at least 1, 2, or 3 carbon atoms and/or up to 6, 8, or 10 carbon atoms, which can include one or more heteroatoms (e.g., N, O, S) as well as the various carbonyl (ketone, aldehyde, ester, etc.), hydroxyl, aromatic, and ethylenic groups mentioned above).

In a particular refinement, (i) the functional group comprises an ether $R_1$—O—$R_2$ group, (ii) the corresponding ECH or ECHDO reaction products comprise one or more of a $R_1$H, $R_2$OH, $R_1$OH, and $R_2$H, (iii) $R_1$ is a substituted or unsubstituted aromatic or heteroaromatic substituent containing 3 to 20 carbon atoms (e.g., $R_1$ can have at least 3, 4, 5, or 6 and/or up to 6, 8, 10, 15, or 20 carbon atoms, which can include one or more heteroatoms (e.g., N, O, S) as well as the various carbonyl (ketone, aldehyde, ester, etc.), hydroxyl, aromatic, and ethylenic groups mentioned above), and (iv) $R_2$ is a substituted or unsubstituted alkyl substituent containing from 1 to 10 carbon atoms (e.g., $R_2$ can be organic or hydrocarbon substituents having at least 1, 2, or 3 carbon atoms and/or up to 6, 8, or 10 carbon atoms, which can include one or more heteroatoms (e.g., N, O, S) as well as the various carbonyl (ketone, aldehyde, ester, etc.), hydroxyl, aromatic, and ethylenic groups mentioned above). Suitably, there is a preferential yield of $R_1$H and/or $R_2$OH over $R_1$OH and/or $R_2$H products, respectively, as intermediate or final products with a high selectivity (e.g., selectivity of at least 0.8, 0.85, 0.9, 0.95, 0.98, or 0.99 for $R_1$H and/or $R_2$OH; selectivity of 0.2, 0.15, 0.1, 0.05, 0.02, 0.01 or less for $R_1$OH, $R_2$H, or $H_2$), in particular when the $R_1$ aromatic group has an oxygen or other electronegative substituent (e.g., a phenolic group). In various embodiments, a high conversion of the $R_1$—O—$R_2$ substrate can be obtained (e.g., conversion of at least 0.8, 0.85, 0.9, 0.95, 0.98, or 0.99).

In another refinement, (i) the functional group comprises an ether $R_1$—O—$R_2$ group, (ii) the corresponding ECH or ECHDO reaction products comprise one or more of $R_1$*H and $R_2$OH, (iii) $R_1$ is a substituted or unsubstituted aromatic or heteroaromatic substituent containing 3 to 20 carbon atoms, (iv) $R_1$* is a hydrogenated analog of $R_1$, and (v) $R_2$ is a substituted or unsubstituted alkyl substituent containing from 1 to 10 carbon atoms. $R_1$ and $R_2$ can have the same refinements as noted above (e.g., related to the number of carbon atoms, presence and nature of heteroatoms, etc.). $R_1$*, as the hydrogenated analog of $R_1$, can be a substituted or unsubstituted cycloalkyl or cycloheteroalkyl substituent containing 3 to 20 carbon atoms (e.g., as similarly refined above with respect to $R_1$) which is completely saturated/hydrogenated relative to $R_1$. For example, when $R_1$ is a 2-substituted phenol such as in 2-methoxyphenol (guaiacol), then $R_1$*H is cyclohexanol (i.e., where both the aromatic phenolic ring and the cleaved methoxy bond have been hydrogenated). In the event of partial/incomplete saturation relative to $R_1$, $R_1$* can include corresponding cycloalkenyl or cycloheteroalkenyl analogs of $R_1$. Suitably, there is a preferential yield of $R_1$*H and/or $R_2$OH over corresponding $R_1$*OH and/or $R_2$H products, respectively, as intermediate or final products with a high selectivity (e.g., selectivity of at least 0.8, 0.85, 0.9, 0.95, 0.98, or 0.99 for $R_1$*H and/or $R_2$OH; selectivity of 0.2, 0.15, 0.1, 0.05, 0.02, 0.01 or less for $R_1$*OH, $R_2$H, or $H_2$), in particular when the $R_1$ aromatic group has an oxygen or other similarly electronegative substituent (e.g., as in a phenolic group) such as in the 2-(or ortho-) position relative to the —$OR_2$ group in the $R_1$—O—$R_2$ ether substrate. In various embodiments, a high conversion of the $R_1$—O—$R_2$ substrate can be obtained (e.g., conversion of at least 0.8, 0.85, 0.9, 0.95, 0.98, or 0.99).

In various embodiments, the initial reaction mixture can comprise a plurality of different organic reactants each comprising one or more of the functional groups, and the final reaction mixture can comprise a plurality of corresponding ECH reaction products and/or ECHDO reaction products. In a refinement, the reaction mixture can comprise a plurality of the organic reactants, the plurality being selected from the group consisting of a multicomponent lignin depolymerization product, a multicomponent lignin depolymerization product fraction, a plurality of lignin depolymerization product components, and combinations thereof. The lignin depolymerization product can represent a multicomponent mixture of phenolic, methoxylated monomers and oligomers (e.g., with 2-10 phenolic residues) resulting from the treatment of lignin-containing biomass (e.g., ammonia-fiber expansion (AFEX)-lignin; black/brown liquor streams).

In another refinement, the reaction mixture can comprise a plurality of the organic reactants, the plurality being selected from the group consisting of a multicomponent bio-oil, a multicomponent bio-oil fraction, a plurality of bio-oil components, and combinations thereof (e.g., a reaction product produced from the fast pyrolysis of (lignocellulosic) biomass or a fraction/subset of the components thereof). In an embodiment, the pyrolytic process is performed in the same facility as the ECH/ECHDO treatment. In another embodiment, the bio-oil from the pyrolytic process is subjected to the ECH/ECHDO treatment within 1 hr, 2 hr, 4 hr, 8 hr, or 24 hr from formation of the bio-oil (for example to permit fractionation or other intermediate processing before ECH/ECHDO treatment). In one refinement, the reaction mixture is free from added solvents (e.g., the ECH/ECHDO treatment is performed on the bio-oil (or more generally other organic reactants) without solvents, such as where the organic reactant(s) is initially at least about 90%, 95%, 98%, or 99% by weight of the reaction mixture. In a further refinement, the reaction mixture can comprise the multicomponent bio-oil fraction, the fraction having been obtained by extraction of bio-oil using a solvent comprising one or more of water, methanol, ethanol, diethyl ether, ethyl acetate, dichloromethane, chloroform, toluene, and hexane (e.g., thus providing a water-soluble or other specific solvent-soluble bio-oil fraction, etc.). In another refinement, the reaction mixture comprises one or more of water and a water-miscible organic solvent (e.g., methanol, ethanol, 1-propanol, 2-propanol, 1-butanol, tetrahydrofuran, and mixtures thereof). In an embodiment, the reaction mixture comprises water and the water is present in an amount of at least 10 wt. %, 12 wt. %, 15 wt. %, 20 wt. %, 25 wt. %, or 30 wt. % and/or up to 20 wt. %, 30 wt. %, 40 wt. %, 50 wt. %, 70 wt. %, 90 wt. %, or 95 wt. % relative to the reaction mixture (with similar concentrations being applicable for the organic reactants individually or collectively in the reaction mixture). In various embodiments, the reaction mixture comprises one or more reactants selected from the group consisting of acetol, hydroxyacetaldehyde, glyoxal, formaldehyde, acetic acid, phenol, guaiacol, syringol, levoglucosan, furfural, glucose, xylose, substituted derivatives thereof, and combinations thereof (e.g., a plurality of bio-oil pyrolysis products as reactants or derived from another source). Similarly, the reaction product comprises one or more of ethylene glycol, propylene glycol, cyclohexanol, furfuryl alcohol, and methanol (e.g., resulting from a bio-oil or other organic reactant feed stream).

The reaction processes can be performed with a variety of operating conditions. While the ECH/ECHDO reactions are suitably performed under mild/ambient conditions (e.g., 0° C. to 100° C. and 0.8 atm to 1.2 atm), the operating conditions can be extended to other temperature and/or pressure values. For example, the ECH or ECHDO reaction can be performed as a batch or a continuous process. In one refinement, the ECH or ECHDO reaction is performed in an undivided electrochemical cell containing the reaction mixture, wherein the second electrode is in contact with the reaction mixture in the electrochemical cell. In another refinement, the ECH or ECHDO reaction is performed in a divided electrochemical cell containing the reaction mixture, wherein the second electrode is in contact with an anolyte mixture in electrical connection with the reaction medium via an ion-exchange membrane. In various embodiments, the ECH or ECHDO reaction is performed at a temperature of at least 0° C., 20° C., 25° C., 30° C., 50° C., or 70° C. and/or up to 30° C., 50° C., 70° C., 80° C., 90° C., 100° C., 150° C., 200° C., 250° C. or 300° C. (e.g., below the boiling point of the reaction medium/solvent system therefor, including pressurized reaction vessels permitting elevated temperatures above the normal (atmospheric pressure) boiling point, such as a water reaction medium at an appropriate elevated pressure permitting reaction temperatures above 100° C.). The ECH or ECHDO reaction can be performed at a pressure of at least 0.5 atm, 0.8 atm, or 1 atm and/or up to 1.2 atm, 1.5 atm, 2 atm, 5 atm, 10 atm, 20 atm, 40 atm, or 50 atm. The ECH or ECHDO reaction can be performed at a current density of at least 10 mA/dm$^2$, 50 mA/dm$^2$, 100 mA/dm$^2$, 200 mA/dm$^2$, or 500 mA/dm$^2$ and/or up to 100 mA/dm$^2$, 200 mA/dm$^2$, 500 mA/dm$^2$, 1000 mA/dm$^2$, 2000 mA/dm$^2$, 5000 mA/dm$^2$, or 10000 mA/dm$^2$. The organic reactant can have a concentration in the initial reaction mixture of at least 1 mM, 2 mM, 5 mM, 10 mM, 20 mM, 50 mM, or 100 mM and/or up to 50 mM, 100 mM, 200 mM, 500 mM, 1,000 mM, 5,000 mM or 10,000 mM (e.g., as the concentration of a single organic reactant or as the total concentration of multiple organic reactants in the initial reaction mixture). In an embodiment, the reaction mixture further comprises a surfactant (e.g., a cationic surfactant such as cetyltrimethylammonium bromide (CTAB) or didodecyldimethylammonium bromide (DDAB)). In another embodiment, the reaction mixture further comprises an electrolyte. In some embodiments, the reaction mixture can be free from added solvents (e.g., the reaction medium is composed essentially entirely of one or more organic reactants, with optional ingredients such as pH agents, surfactants, etc.; such as where the organic reactant(s) is initially at least about 90%, 95%, 98%, or 99% by weight of the reaction mixture). In other embodiments, the reaction mixture can further comprise a solvent system for the organic reactant (e.g., an aqueous (water) solvent system, an organic solvent system (e.g., a water-miscible or water-immiscible system), or a combination thereof; suitably selected to solvate reactants and products). For example, the solvent system can comprise water and/or one or more water-miscible organic solvents (e.g., to provide an aqueous medium as the reaction mixture). Suitable water-miscible solvents can include methanol, ethanol, 1-propanol, 1-butanol, tetrahydrofuran, and mixtures thereof.

In another aspect, the disclosure relates to a reaction apparatus/system comprising an electrochemical cell (e.g., divided or undivided cell), the electrochemical cell comprising a cathode and an anode in electrical communication with each other (e.g., via an intermediate power supply or other means for applying a voltage potential between the electrodes/supplying electrons to the cathode). The cathode comprises the skeletal metal catalyst according to any of the variously disclosed embodiments. When the electrochemical cell contains an appropriate reaction mixture including one or more organic reactants and an electrolyte (e.g., an anolyte and a catholyte in a divided cell system) a completed circuit is formed with the anode and cathode being in electrical communication/contact via the reaction mixture/electrolyte.

Additional features of the disclosure may become apparent to those skilled in the art from a review of the following detailed description, taken in conjunction with the drawings, examples, and appended claims.

BRIEF DESCRIPTION OF THE DRAWINGS

For a more complete understanding of the disclosure, reference should be made to the following detailed description and accompanying drawings wherein.

Figure 1:
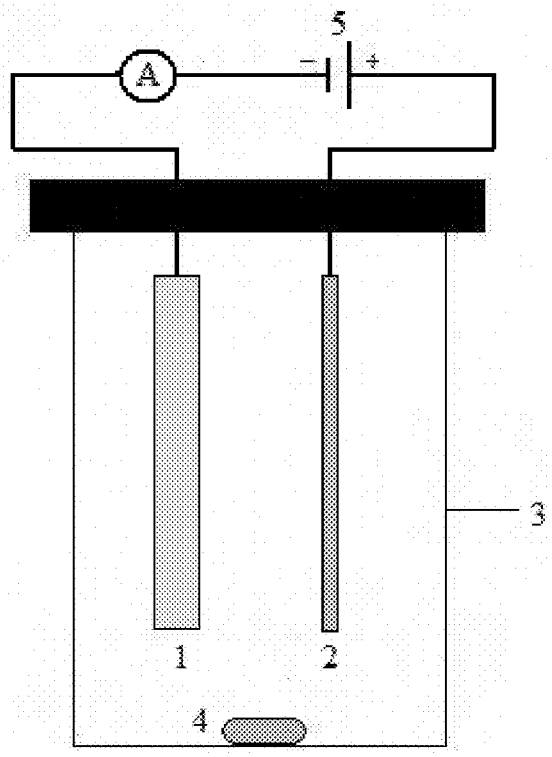
FIG. 1 illustrates an undivided electrochemical cell composed of cathode 1 and anode 2 in the same electrochemical chamber 3. Bio-oil (or another organic reactant) is added into the electrochemical chamber 3 for the electrocatalytic hydrogenation. Power supply 5 provides electrons to cathode 1 for the reduction reaction, while the anode 2 releases electrons to the power supply. Stirring is used to enhance mass transfer with a magnetic stirring bar 4. An ammeter is used to measure the current.

While the disclosed processes, compositions, and methods are susceptible of embodiments in various forms, specific embodiments of the disclosure are illustrated in the drawings (and will hereafter be described) with the understanding that the disclosure is intended to be illustrative, and is not intended to limit the claims to the specific embodiments described and illustrated herein.

DETAILED DESCRIPTION

Mobile organisms use hydrocarbon-like fats and oils as their portable energy storage materials, whether they are warm- or cold-blooded, vertebrate or in-; aquatic, terrestrial or airborne. With their high specific energies (e.g., about 42-48 MJ $kg^{-1}$ for hydrocarbon fuels such as gasoline and diesel compared with about 12-18 MJ $kg^{-1}$ for dry biomass), low toxicity, and ease of handling, these potent fuels hold a privileged place in the world's energy economies, both human and biospheric. But human combustion of hydrocarbon fuels today consumes finite petroleum reserves while annually releasing roughly 11 billion tonnes of $CO_2$ (as of 2009), a bit over ⅓ of anthropogenic fossil $CO_2$ injection into the atmosphere worldwide. Clearly, these essential fuels must eventually come from carbon-neutral renewable sources.

In principle biomass could serve as a feedstock from which to build renewable hydrocarbon fuels. But despite recent years' huge investments in biomass-to-fuel conversions, a fundamental limitation exists: in the US, the simple thermochemical energy content of potentially available biomass is much smaller (less than ½) than the energy content of petroleum used. Most biofuel schemes simply concentrate the dilute energy content of biomass into a fraction of the matter, throwing away a significant portion of the carbon. Thus, design of any process to produce renewable liquid hydrocarbon fuels from biomass without wasting carbon must energy upgrade to remedy the feedstock's high oxygen content and resulting low specific energy. Though mainly carbohydrate (cellulose and hemicellulose), biomass may contain up to 30% lignin-derived phenolics, oxygenated aromatics whose carbon numbers fall in a range desirable for hydrocarbon fuels.[7] We describe herein the use of low cost electrocatalytic hydrogenation (ECH) to deoxygenate and hydrogenate lignin-relevant model phenols, retaining carbon while raising C:O and H:C ratios as required to form fuel-like products.

Much effort has focused on hydrodeoxygenation of biomass-derived feedstocks using conventional upgrading catalysts suited for centralized petroleum refineries. Starting from biomass fast pyrolysis (BFP)-derived "bio-oils," hydrotreatment at elevated temperatures and pressures can form fully deoxygenated products via classical heterogeneous catalytic hydrotreatment, including attempts with inexpensive catalysts such as Raney Nickel (Ra—Ni). Too, several reports of reductive lignin cleavage by thoughtfully designed homogeneous nickel based catalysts with different reductants have appeared.

Fast pyrolysis (400-600° C. for a few seconds) is a simple method that "melts" biomass into a complex mixture of molecular fragments. The liquid "bio-oil" product can be formed in yields of up to 70%, with gases and char accounting roughly equally for the other 30%. This liquid is a complex mix of sugar and sugar ester fragmentation and dehydration products (e.g. hydroxyacetaldehyde, furfural, hydroxymethylfurfural, levoglucosan, acetic acid), along with phenolic lignin subunits (e.g. guaiacol and syringol). Raw bio-oil is unusable as a transportation fuel, due to its high reactivity, acidity (e.g., about pH 2-3), and water content. With oxygen:carbon ratios (e.g., about 1:1) and specific energy values like biomass itself, bio-oil's energy content is only about ⅓ that of hydrocarbons (e.g., 15 vs. 45 MJ $kg^{-1}$). Moreover, bio-oil's high content of reactive acid, carbonyl and phenolic compounds make it prone to polymerization and oxidation.

However, refinery-based upgrading would require biomass (or bio-oil) transport to the refineries, a significant cost, whereas both BFP and ECH are inexpensive and easily sited regionally. Also, the hydrogen required by these methods must be viewed as a fossil resource despite its lack of carbon; it is derived from natural gas or petroleum refining in today's markets. Recent advances in water splitting catalysts have opened the door to electrolytic hydrogen production using renewable electricity, but a more ideal scenario would use protons from water oxidation directly for liquid fuel hydrogenation in-situ, bypassing the gas phase entirely. It is this idea that leads to the present ECH study applied to model lignin substrates.

Compared to classical hydrogenation, ECH is mild, occurring at ambient pressures and below the boiling point of electrolyte/co-solvent (usually water). Furthermore, because it is heterogeneous and monolithic, removal of an ECH catalyst from a reaction is a trivial physical step.

The recently reported cobalt phosphate water oxidation catalyst, supported on a stainless steel grid, provides a convenient, inexpensive alternative to the conventional platinum mesh anode. In our experiments, it operates for many hours with no signs of physical degradation or activity loss.

Raney Nickel (Ra—Ni) is a well-known low cost metal catalyst that is active and efficient for aromatic ring hydrogenation. It is also readily deposited on electrode surfaces via electroplating. Ra—Ni can cleave model lignin oligomers into smaller fragments and may further hydrogenate them, depending on conditions. As disclosed herein, alkoxyphenols undergo aryl-ether bond cleavage to form phenol, which is then hydrogenated to cyclohexanol, as shown in scheme 1, and the bond cleavage is relatively insensitive to the R-group size. However, it is affected by substitution position relative to the phenol —OH moiety.

Scheme 1. Galvanostatic ECH of alkoxyphenols to cyclohexanol raising specific energy. A: Alkoxyphenol, 27.5 MJ $kg^{-1}$ (starting material; R = $CH_3$); B: Phenol, 31.0 MJ $kg^{-1}$ (intermediate); C: Alkoxycyclohexanol, 30.4 MJ $kg^{-1}$ (traces; R = $CH_3$); D: Cyclohexanol, 34.5 MJ $kg^{-1}$ (major product).

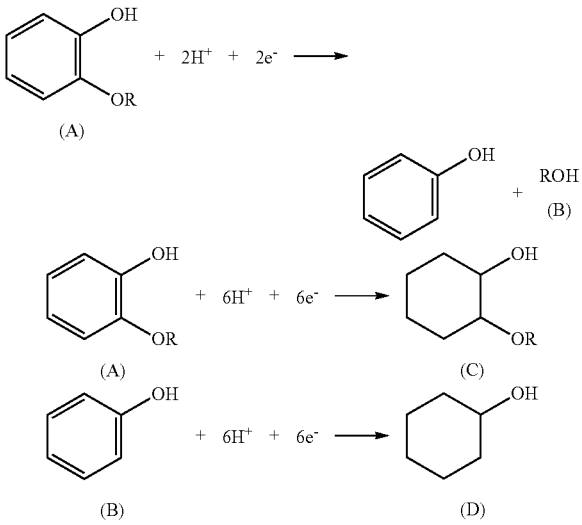

In an aspect, the disclosure relates to a process for the electrocatalytic hydrogenation and/or hydrodeoxygenation of oxygenated and/or unsaturated organic compounds (e.g., biomass-derived bio-oil or constituents thereof) by the production of hydrogen atoms on a catalyst surface followed by the reaction of the hydrogen atoms with the organic compounds, wherein the catalyst is a porous, high surface area metal material such as a skeletal metal catalyst. Electrocatalytic hydrogenation and/or hydrodeoxygenation are disclosed herein to stabilize bio-oil or other organic reactants under mild conditions to reduce the coke formation. Electrocatalytic hydrogenation and hydrodeoxygenation is used to convert oxygen containing functionalities and unsaturated carbon-carbon bonds into chemically reduced forms with an increased hydrogen content. It is operated at mild conditions, for example at lower than 100° C. and ambient pressure, which enables it to be a good means for stabilizing bio-oils or related organic reactants to a form that can be stored and transported using metal containers and pipes. In particular, a catalyst including Raney Nickel (Ra—Ni) or other skeletal catalysts on a suitable support (e.g., a stainless steel electrode or other conducting material) is employed as the cathode.

Before electrocatalytic hydrogenation and/or hydrodeoxygenation, bio-oil (or other organic reactants more generally) can be pretreated to increase its conductivity. Three different ways for bio-oil pretreatment include, but are not limited to, 1) electrolytes are added into the bio-oil directly; 2) bio-oil is dissolved in a solvent, such as mixture of methanol and water, and electrolytes are added into the bio-oil and solvent mixture; or 3) separation/extraction of bio-oil using water (or other solvent) is performed to form a water-soluble fraction and a water-insoluble fraction, and electrolytes are added into the water-soluble fraction to perform electrocatalytic hydrogenation.

The pretreated bio-oil is then stabilized in an electrochemical cell using electrocatalytic hydrogenation and/or hydrodeoxygenation. Electrocatalytic hydrogenation and/or hydrodeoxygenation of bio-oil can be performed at temperatures below 100° C. and ambient pressure. Elevated pressure can also be employed if desired. Electrocatalytic hydrogenation and/or hydrodeoxygenation is suitably performed at a current range from several mA to several A, and a voltage range from several V to hundreds of V.

Electrocatalytic hydrogenation and/or hydrodeoxygenation of bio-oil can be operated in two different electrochemical cells: an undivided electrochemical cell and a divided electrochemical cell.

An example of the undivided cell is shown in FIG. 1, where the cathode 1 and the anode 2 are in the same electrochemical chamber 3. In general, various materials can be used as the cathode, including aluminum, iron, zinc, copper, stainless steel, graphite, activated carbon cloth, but not limited to these materials. To avoid oxidation of bio-oil compounds at the anode side, a sacrificial anode can be used, such as sacrificial nickel, but not limited to nickel. In an embodiment, the cathode can include an electrocatalytic electrode composition including porous skeletal catalytic metal (e.g., Ra—Ni) particles supported on an electrode material such as stainless steel. The pretreated bio-oil is used as the electrolysis solution.

Figure 2:
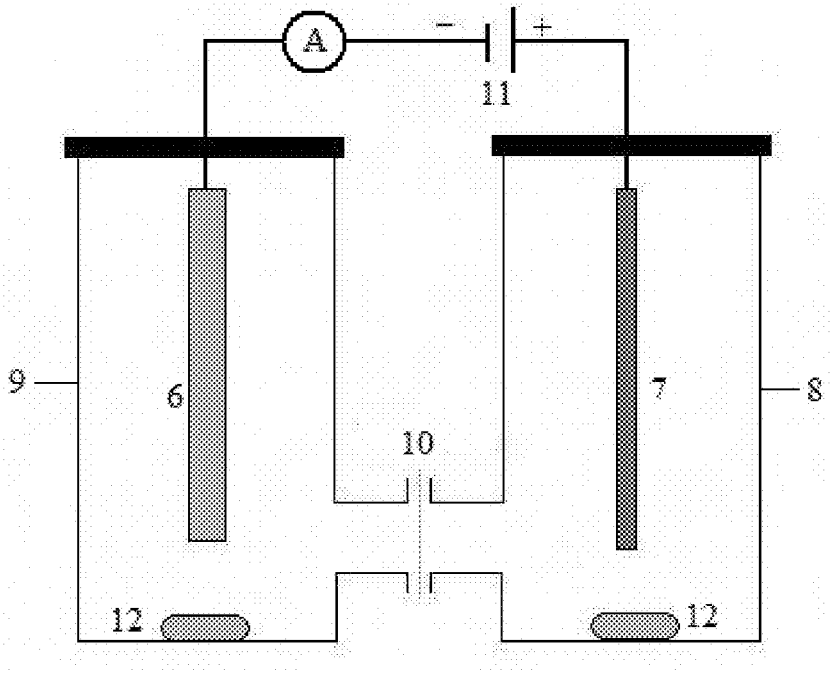
FIG. 2 illustrates a divided electrochemical cell composed of cathode 6 and anode 7 in different electrochemical chambers (anode chamber 8 and cathode chamber 9) separated by an ion exchange membrane 10. Bio-oil (or another organic reactant) is added into the cathode chamber 9 and aqueous solution with electrolytes is put into the anode chamber 8. Power supply 11 provides voltage potential driving the electrons to the cathode 6. Magnetic stirring bar 12 is used to mix the solution to enhance mass transfer. An ammeter is used to measure the current.

An example of the divided cell is shown in FIG. 2. The anode chamber 8 and the cathode chamber 9 are separated by an ion exchange membrane 10. NAFION membranes, such as NAFION 115 and NAFION 117, are suitable (available from Dupont), but other membranes can be used as well. Similar to above, the cathode 6 in the divided cell can include an electrocatalytic electrode composition including porous skeletal catalytic metal (e.g., Ra—Ni) particles supported on an electrode material such as stainless steel. More generally, the catalytic metals which can be incorporated into the porous, skeletal catalyst structure include nickel, ruthenium, iron, copper, platinum, palladium, rhodium, iridium, rhenium, osmium, silver, gold, cobalt, molybdenum, gallium, titanium, manganese, zinc, vanadium, chromium, tungsten, and/or tin (e.g., including mixtures, alloys, or other combinations thereof). Raney Nickel as a skeletal metal catalyst is illustrated in the examples below as a cathode catalyst due to its high hydrogenation activity and high stability. A cobalt phosphate water oxidation catalyst (e.g., supported on a stainless steel grid) can be used as the anode 7. In other embodiments, the anode can be made of bulk materials including platinum wire, platinum mesh, platinized titanium mesh, stainless steel wire, stainless steel mesh and graphite rod. Precious metals supported on high surface area material, such as platinum on activated carbon cloth, also can be used as an anode. The pretreated bio-oil is used as the cathode solution and aqueous solutions and different electrolytes can be used as the anode solution.

Figure 3:
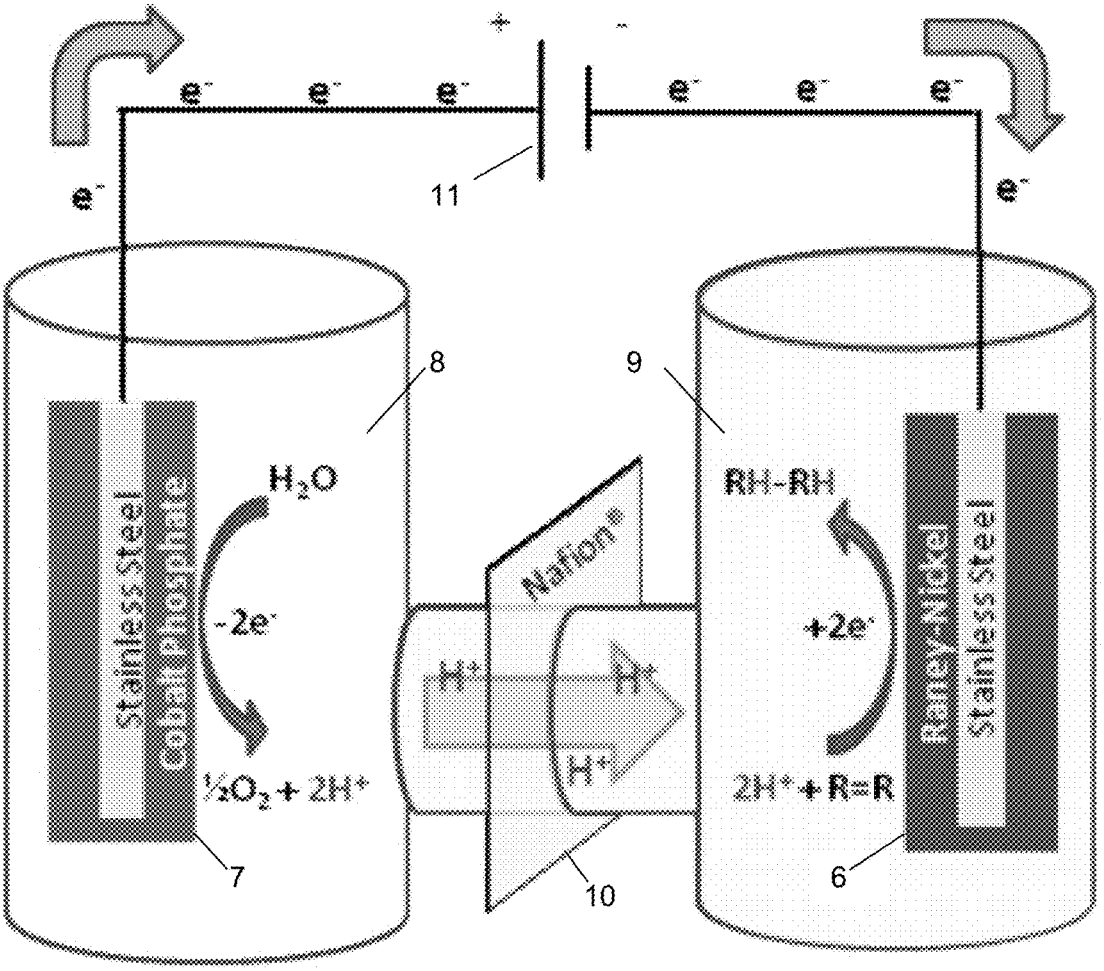
FIG. 3 illustrates a divided electrochemical cell according to an embodiment of the disclosure in which a Raney-Nickel catalyst cathode and a cobalt phosphate water oxidation catalyst anode are used.

FIG. 3 illustrates a divided electrochemical cell according to an embodiment of the disclosure in which a Raney-Nickel catalyst cathode 6 and a cobalt phosphate water oxidation catalyst anode 7 are used. The cobalt-phosphate water oxidation catalyst 7 is immersed in the anode compartment (left) filled with 0.1 M pH 7 phosphate buffer. The Raney Nickel electrode 6 is immersed in the cathode compartment (right), and it is there that ECH of organic compounds takes place. The power supply 11 is used to drive electrons from the anode 7 to the cathode 6 to achieve electrocatalytic hydrogenation. Water oxidation in the anode compartment provides electrons to the circuit, and protons (H+) that travel through the proton exchange membrane (NAFION) to the cathode compartment for ECH. The protons that are combined with the electrons to hydrogenate organic substrates may alternatively simply be obtained from water or acid in the catholyte solution.

Preparation of the Ra—Ni ECH cathode 6 uses the Lessard method of trapping nickel-aluminum alloy particles in an electrodeposited nickel matrix. In short, in a nickel plating bath that contains the Ni—Al alloy powder suspended by stirring, deposition takes place on a stainless steel mesh cathode mounted parallel to a nickel plate anode at a distance of approximately 1 cm. Each side of the cathode mesh is plated for 30 minutes for a total of 2 hours. The ECH anode 7 is prepared by depositing the cobalt-phosphate (Co—P) catalyst on a stainless steel mesh. The current is set to achieve a current density of ca. 1.17 mA $cm^{-2}$ (i.e., a suitable value for catalyst formation). The two ECH electrodes are placed in a conventional divided cell separated by a proton exchange membrane. To increase the solubility of the organic substrates, and serve as a surface active reagent, cationic surfactant may be included in the catholyte. Addition of CTAB (cetyl trimethylammonium bromide) generally improves selectivity for organic substrate hydrogenation as opposed to the current-wasting evolution of hydrogen gas as a generally undesired reaction product.

Biomass pyrolysis derived bio-oil (or pyrolysis oil) is a mixture containing hundreds of organic compounds with chemical functionalities that are corrosive to container materials and are prone to polymerization. Bio-oil is a condensed liquid oxygenated hydrocarbon product of the fast pyrolysis of biomass (e.g., agricultural biomass, forest biomass). Biomass pyrolysis includes heating to moderate temperatures (e.g., 450° C. to 650° C., without oxygen), and vapors formed during pyrolysis are condensed to provide a liquid bio-oil as a complex mixture of various compounds derived from the lignocellulosic precursors in the biomass. The specific composition of a particular bio-oil depends on its particular biomass feedstock, but representative components include water (e.g., 15-40 wt. %), pyrolitic lignin (e.g., 15-40 wt. %, including guaiacols, catechols, syringols, vanillins, etc.), carboxylic acids (e.g., 3-10 wt. % acetic acid, 2-8 wt. % formic acid), aldehydes and ketones (e.g., 5-15 wt. % glycolaldehyde; 2-8 wt. % acetol; 0.5-5 wt. % glyoxal; 1-6 wt. % formaldehyde, 2-8 wt. % acetaldehyde), and various carbohydrate pyrolysis derivatives (e.g., glucose, xylose, levoglucosan).

Bio-oil as obtained is generally a viscous, acidic brown oil (e.g., having a pH value of about 1-3). Suitable biomass sources for bio-oil formation include plants, trees (e.g., pine trees), agricultural crops, crop residues, grasses, forest and mill residues, wood and wood waste (e.g., saw dust), paper mill waste, and/or waste paper. Representative biomass constituents include cellulose, lignin, hemicellulose, fatty acids, and/or triglycerides, with particular components and amounts varying based on the source of the biomass. As described herein, bio-oil can be separated into a water-soluble fraction and a water-insoluble fraction by an aqueous extraction process for further processing by ECH/ECHDO of a subset of the original bio-oil constituents. Similarly, when a different solvent/extraction medium is used (e.g., non-aqueous solvent(s) alone or in combination with water as a solvent mixture), the bio-oil can be separated into a solvent-soluble fraction and a solvent-insoluble fraction for subsequent processing.

As noted, bio-oil as originally obtained from pyrolysis is a complex mixture of many different organic compounds having various chemical functionalities. Examples of specific reactant compounds include one or more of formaldehyde, acetaldehyde, glycolaldehyde, propanal, butanal, butanedial, acetone, 2,3-butanedione, formic acid, acetic acid, methyl acetate, propanoic acid, acetol, 1-hydroxy-2-butanone, furfural, furfuryl alcohol, 2-furanone, cyclopentanone, 3-methyl-2-cyclopentenone, 3-methyl-1,2-cyclopentanedione, levoglucosan, glucose, xylose, phenol, 2-methylphenol (cresols more generally), guaiacol, 4-ethylguaiacol, eugenol, isoeugenol, methoxyeugenol, syringol, and trimethoxybenzene (1,2,3- and other isomers). More generally, representative bio-oil constituents (or organic reactants from a different feedstock) can include linear, cyclic, or branched hydrocarbons and heteroatom-substituted hydrocarbons having at least 1, 2, or 3 carbon atoms and/or up to 6, 8, 10, 15, or 20 carbon atoms, for example having the various noted oxygen-containing and unsaturated/aromatic functional groups amenable to ECH/ECHDO according the disclosure. In some embodiments, higher molecular weight constituents may be present in the bio-oil, for example representing constituents from the original lignocellulosic biomass, incomplete pyrolysis products therefrom, and/or subsequent oligomerization/polymerization products from the low molecular weight pyrolysis bio-oil constituents.

Reaction products resulting from the ECH/ECHDO of bio-oil, fractions thereof, or components thereof generally correspond to the reduced/hydrogenated and/or deoxygenated forms of their respective reactants. Examples of specific product compounds include one or more of ethanol, 1-propanol, 2-propanol, 1-butanol, tetrahydrofurfuryl alcohol, cyclopentanol, cyclohexanol, ethylene glycol, propylene glycol, 1,2-butanediol, 1,4-butanediol, and sorbitol. More generally, representative ECH/ECHDO reaction products (from bio-oil constituents or organic reactants from a different feedstock) can include linear, cyclic, or branched hydrocarbons and heteroatom-substituted hydrocarbons having at least 1, 2, or 3 carbon atoms and/or up to 6, 8, 10, 15, or 20 carbon atoms, for example including linear, cyclic, or branched alcohols, diols, polyols, saturated alkanes, and saturated heteroatom-substituted alkanes.

The disclosed process is illustrated and described in the context of the electrocatalytic hydrogenation and/or hydrodeoxygenation of bio-oil, but it is not limited to bio-oil. Other organic compounds with unsaturated and/or oxygen-containing carbon bonds or organic compound mixtures containing such functional groups can also be reduced/hydrogenated or deoxygenated using the disclosed methods and compositions. In addition to bio-oil, an example of another bio-based feedstock with organic compounds suitable for ECH/ECHDO treatment includes lignin depolymerization products (e.g., multicomponent mixtures thereof, fractions thereof, etc.) with one or more phenolic, methoxylated monomers and related oligomers (e.g., with 2-10 phenolic residues) resulting from the treatment of lignin-containing biomass (e.g., ammonia-fiber expansion (AFEX)-lignin; black/brown liquor streams).

Specific contemplated aspects of the disclosure are herein described in the following numbered paragraphs.

1. A process for performing at least one of electrocatalytic hydrogenation (ECH) and electrocatalytic hydrodeoxygenation (ECHDO) of an organic substrate, the process comprising: (a) providing a reaction mixture comprising an organic reactant comprising one or more functional groups selected from the group consisting of carbonyl carbon-oxygen double bonds, aromatic double bonds, ethylenic carbon-carbon double bonds, acetylenic carbon-carbon triple bonds, hydroxyl carbon-oxygen single bonds, ether carbon-oxygen single bonds, and combinations thereof; (b) contacting the reaction mixture with a first electrode and a catalytic composition comprising a skeletal metal catalyst capable of catalyzing at least one of electrocatalytic hydrogenation (ECH) and electrocatalytic hydrodeoxygenation (ECHDO); (c) electrically contacting the reaction mixture with a second electrode; and (d) applying an electrical potential between the first electrode and the second electrode to provide an electrical current therebetween and through the reaction mixture, thereby performing at least one of an ECH reaction and an ECHDO reaction to reduce or deoxygenate at least one of the functional groups of the organic reactant and to form at least one of (i) an ECH reaction product thereof and (ii) an ECHDO reaction product thereof; wherein the reaction mixture has a pH value ranging from 4 to 11 when applying the electrical potential to form the reaction product.

2. The process of the preceding paragraph, wherein the pH value of the reaction mixture is at least 5, 6, 7, or 8 and/or up to 7, 8, 9, or 10.

3. The process of any of the preceding paragraphs, wherein the reaction mixture has an initial pH value ranging from 4 to 10 and is maintained in the range from 4 to 10 during the application of the electrical potential to form the reaction product.

4. The process of any of the preceding paragraphs, wherein the reaction mixture further comprises a pH buffer to maintain the pH value of the reaction mixture in a selected range during the application of the electrical potential to form the reaction product.

5. The process of any of the preceding paragraphs, wherein the metal of the skeletal metal catalyst is selected from the group consisting of Ru, Ni, Fe, Cu, Pt, Pd, Rh, Ir, Re, Os, Ag, Au, Co, Mo, Ga, Ti, Mn, Zn, V, Cr, W, Sn, mixtures thereof, alloys thereof, and combinations thereof.

6. The process of any of the preceding paragraphs, wherein the metal of the skeletal metal catalyst comprises at least one of Ni and a Ni-containing alloy.

7. The process of any of the preceding paragraphs, wherein the skeletal metal catalyst comprises an alkaline leaching product of an alloy comprising (i) aluminum and (ii) the metal (e.g., nickel) of the skeletal metal catalyst.

8. The process of any of the preceding paragraphs, wherein the skeletal metal catalyst has a microporous structure with a specific BET surface area of at least 5 $m^2/g$ or 10 $m^2/g$ and/or up to 20 $m^2/g$, 40 $m^2/g$, 60 $m^2/g$, or 100 $m^2/g$.

9. The process of any of the preceding paragraphs, wherein the catalytic composition is immobilized on the first electrode.

10. The process of the preceding paragraph, wherein the catalyst composition comprises an alkaline leaching product of a composite material comprising (i) a metal matrix and (ii) an alloy comprising (A) aluminum and (B) the metal of the skeletal metal catalyst.

11. The process of any of the preceding paragraphs, wherein the catalyst composition is capable of catalyzing at least one of (i) ECH of unsaturated carbon-carbon bonds in an organic substrate, (ii) ECH of carbon-oxygen double bonds in an organic substrate, and (iii) ECHDO of carbon-oxygen single bonds in an organic substrate.

12. The process of any of the preceding paragraphs, wherein the organic reactant has a conversion of at least 80%, 85%, 90%, 95%, 98%, or 99%.

13. The process of any of the preceding paragraphs, wherein the organic reactant has a selectivity of at least 80%, 85%, 90%, 95%, 98%, or 99% for the formation of the ECH reaction product, the ECHDO reaction product, or both combined.

14. The process of any of the preceding paragraphs, wherein the organic reactant comprises the aromatic double bonds and at least 80%, 85%, 90%, 95%, 98%, or 99% of the aromatic double bonds are hydrogenated via ECH in the ECH reaction product.

15. The process of any of the preceding paragraphs, wherein the organic reactant comprises the ether carbon-oxygen single bonds and at least 80%, 85%, 90%, 95%, 98%, or 99% of the ether carbon-oxygen single bonds are cleaved via ECHDO in the ECHDO reaction product.

16. The process of any of the preceding paragraphs, wherein the carbonyl carbon-oxygen double bonds are present and in a functional group selected from the group consisting of ketone groups, aldehyde groups, carboxylic acid groups, ester groups, amide groups, enone groups, acyl halide groups, acid anhydride groups, and combinations thereof.

17. The process of any of the preceding paragraphs, wherein the aromatic double bonds are present and in a functional group selected from the group consisting of benzenes, phenols, furans, pyridines, pyrazines, imidazoles, pyrazoles, oxazoles, thiophenes, naphthalenes, higher fused aromatics, and combinations thereof.

18. The process of any of the preceding paragraphs, wherein the functional group comprises a C═O group, and the corresponding ECH reaction product comprises at least one of a C—OH group and a $CH_2$ group.

19. The process of any of the preceding paragraphs, wherein the functional group comprises an aromatic CH group, and the corresponding ECH reaction product comprises a $CH_2$ group.

20. The process of any of the preceding paragraphs, wherein the functional group comprises an ethylenic C═C group, and the corresponding ECH reaction product comprises a CH—CH group.

21. The process of any of the preceding paragraphs, wherein the functional group comprises a C OH group, and the corresponding ECHDO reaction product comprises a CH group.

22. The process of any of the preceding paragraphs, wherein the functional group comprises a (C═O)O group, and the corresponding ECHDO reaction product comprises at least one of a (C═O)H group and a C—OH group.

23. The process of any of the preceding paragraphs, wherein the functional group comprises an ether $R_1$—O—$R_2$ group, and the corresponding ECH or ECHDO reaction products comprise one or more of a $R_1H$, $R_2OH$, $R_1OH$, and $R_2H$, where $R_1$ and $R_2$ are substituents containing from 1 to 10 carbon atoms.

24. The process of any of the preceding paragraphs, wherein: (i) the functional group comprises an ether $R_1$—O—$R_2$ group, (ii) the corresponding ECH or ECHDO reaction products comprise one or more of a $R_1H$, $R_2OH$, $R_1OH$, and $R_2H$, (iii) $R_1$ is a substituted or unsubstituted aromatic or heteroaromatic substituent containing 3 to 20 carbon atoms, and (iv) $R_2$ is a substituted or unsubstituted alkyl substituent containing from 1 to 10 carbon atoms.

25. The process of any of the preceding paragraphs, wherein the initial reaction mixture comprises a plurality of different organic reactants each comprising one or more of the functional groups, and the final reaction mixture comprises a plurality of corresponding ECH reaction products and/or ECHDO reaction products.

26. The process of any of the preceding paragraphs, wherein the reaction mixture comprises a plurality of the organic reactants, the plurality being selected from the group consisting of a multicomponent bio-oil, a multicomponent bio-oil fraction, a plurality of bio-oil components, and combinations thereof.

27. The process of any of the preceding paragraphs, wherein the reaction mixture comprises a plurality of the organic reactants, the plurality being selected from the group consisting of a multicomponent lignin depolymerization product, a multicomponent lignin depolymerization product fraction, a plurality of lignin depolymerization product components, and combinations thereof.

28. The process of any of the preceding paragraphs, further comprising: (e) recovering or separating the reaction product from the reaction mixture.

29. The process of any of the preceding paragraphs, comprising performing the ECH or ECHDO reaction as a batch or a continuous process.

30. The process of any of the preceding paragraphs, comprising performing the ECH or ECHDO reaction at a temperature of at least 0° C., 20° C., 25° C., 30° C., 50° C., or 70° C. and/or up to 30° C., 50° C., 70° C., 80° C., 90° C., 100° C., 150° C., 200° C., 250° C. or 300° C.

31. The process of any of the preceding paragraphs, comprising performing the ECH or ECHDO reaction at a pressure of at least 0.5 atm, 0.8 atm, or 1 atm and/or up to 1.2 atm, 1.5 atm, 2 atm, 5 atm, 10 atm, 20 atm, 40 atm, or 50 atm.

32. The process of any of the preceding paragraphs, comprising performing the ECH or ECHDO reaction at a current density of at least 10 mA/dm$^2$, 50 mA/dm$^2$, 100 mA/dm$^2$, 200 mA/dm$^2$, or 500 mA/dm$^2$ and/or up to 100 mA/dm$^2$, 200 mA/dm$^2$, 500 mA/dm$^2$, 1000 mA/dm$^2$, 2000 mA/dm$^2$, 5000 mA/dm$^2$, or 10000 mA/dm$^2$.

33. The process of any of the preceding paragraphs, wherein the organic reactant has a concentration in the initial reaction mixture of at least 1 mM, 2 mM, 5 mM, 10 mM, 20 mM, 50 mM, or 100 mM and/or up to 50 mM, 100 mM, 200 mM, 500 mM, 1,000 mM, 5,000 mM or 10,000 mM.

34. The process of any of the preceding paragraphs, wherein the reaction mixture further comprises a surfactant.

35. The process of any of the preceding paragraphs, wherein the reaction mixture further comprises a solvent system for the organic reactant.

36. The process of any of the preceding paragraphs, wherein the solvent system comprises water and one or more water-miscible organic solvents to provide an aqueous medium as the reaction mixture.

37. The process of any of the preceding paragraphs, wherein the reaction mixture further comprises an electrolyte.

38. The process of any of the preceding paragraphs, wherein the second electrode comprises an electrically conductive material selected from the group consisting of stainless steel, silver, nickel, platinum, carbon, lead, lead dioxide, indium tin oxide, mixtures thereof, alloys thereof, and combinations thereof.

39. The process of any of the preceding paragraphs, wherein the second electrode comprises cobalt(III) phosphate.

40. The process of any of the preceding paragraphs, comprising performing the ECH or ECHDO reaction in an undivided electrochemical cell containing the reaction mixture, wherein the second electrode is in contact with the reaction mixture in the electrochemical cell.

41. The process of any of the preceding paragraphs, comprising performing the ECH or ECHDO reaction in a divided electrochemical cell containing the reaction mixture, wherein the second electrode is in contact with an anolyte mixture in electrical connection with the reaction medium via an ion-exchange membrane.

42. A process for performing at least one of electrocatalytic hydrogenation (ECH) and electrocatalytic hydrodeoxygenation (ECHDO) of an organic substrate, the process comprising: (a) providing a reaction mixture comprising a plurality of organic reactants, wherein: (i) the plurality of organic reactants is selected from the group consisting of a multicomponent bio-oil, a multicomponent bio-oil fraction, a plurality of bio-oil components, and combinations thereof, and (ii) the organic reactants collectively comprise one or more functional groups selected from the group consisting of carbonyl carbon-oxygen double bonds, aromatic double bonds, ethylenic carbon-carbon double bonds, acetylenic carbon-carbon triple bonds, hydroxyl carbon-oxygen single bonds, ether carbon-oxygen single bonds, and combinations thereof; (b) contacting the reaction mixture with a first electrode and a catalytic composition comprising a skeletal metal catalyst capable of catalyzing at least one of electrocatalytic hydrogenation (ECH) and electrocatalytic hydrodeoxygenation (ECHDO); (c) electrically contacting the reaction mixture with a second electrode; and (d) applying an electrical potential between the first electrode and the second electrode to provide an electrical current therebetween and through the reaction mixture, thereby performing at least one of an ECH reaction and an ECHDO reaction to reduce or deoxygenate at least one of the functional groups of the organic reactants and to form at least one of (i) an ECH reaction product thereof and (ii) an ECHDO reaction product thereof.

43. The process of the preceding paragraph, wherein the bio-oil is a reaction product produced from fast pyrolysis of biomass.

44. The process of any of the preceding paragraphs, wherein the reaction mixture is free from added solvents.

45. The process of any of the preceding paragraphs, wherein the reaction mixture comprises one or more of water and a water-miscible organic solvent.

46. The process of any of the preceding paragraphs, wherein the reaction mixture comprises the multicomponent bio-oil fraction, the fraction having been obtained by extraction of bio-oil using a solvent comprising one or more of water, methanol, ethanol, diethyl ether, ethyl acetate, dichloromethane, chloroform, toluene, and hexane.

47. The process of any of the preceding paragraphs, wherein the reaction mixture comprises a plurality of bio-oil pyrolysis products selected from the group consisting of acetol, hydroxyacetaldehyde, glyoxal, formaldehyde, acetic acid, phenol, guaiacol, syringol, levoglucosan, furfural, glucose, xylose, substituted derivatives thereof, and combinations thereof.

48. The process of any of the preceding paragraphs, wherein the reaction product comprises one or more of ethylene glycol, propylene glycol, cyclohexanol, furfuryl alcohol, and methanol.

49. The process of any of the preceding paragraphs, wherein the pH value of the reaction mixture is at least 2, 3, 4, 5, 6, 7 or 8 and/or up to 7, 8, 9, 10, or 11.

50. The process of any of the preceding paragraphs, wherein the reaction mixture further comprises a pH buffer to maintain the pH value of the reaction mixture in a selected range during the application of the electrical potential to form the reaction product.

51. The process of any of the preceding paragraphs, wherein: (i) the functional group comprises an ether $R_1$—O—$R_2$ group, (ii) the corresponding ECH or ECHDO reaction products comprise one or more of $R_1$*H and $R_2$OH, (iii) $R_1$ is a substituted or unsubstituted aromatic or heteroaromatic substituent containing 3 to 20 carbon atoms, (iv) $R_1$* is a hydrogenated analog of $R_1$, and (v) $R_2$ is a substituted or unsubstituted alkyl substituent containing from 1 to 10 carbon atoms.

EXAMPLES

International Publication No. WO 2013/134220 (incorporated herein by reference in its entirety) provides additional disclosure related to the general ECH/ECHDO processes and illustrations of the same using an activated carbon cloth-supported catalytic metal as an cathode material.

The examples illustrate the disclosed processes and compositions, but are not intended to limit the scope of any claims thereto.

Electrocatalytic Upgrading of Model Lignin Monomers with Earth Abundant Metal Electrodes:

Guaiacol (2-methoxyphenol) and related lignin model monomers undergo electrocatalytic hydrogenolysis/hydrogenation (ECH) to cyclohexanol with Raney-Nickel electrodes in aqueous solution. Aryl ether (C—O) bond cleavage is followed by reduction of the aromatic ring at ambient pressure and 75° C. Related arene-OR cleavages occur at similar rates regardless of R-group size. Protons are supplied by anodic water oxidation on a stainless steel grid coated with cobalt-phosphate catalyst, inexpensively replacing the conventional platinum anode, and remaining viable over 16 hours of constant current electrolysis. This method addresses two key barriers to conversion of low specific energy biomass into fuels and chemicals: deoxygenation, and energy upgrading. By directly and simply coupling energy from renewable electricity into the chemical fuel cycle, ECH bypasses the complexity, capital costs and challenging conditions of classic fossil-based $H_2$ hydrotreating, and may help open the door to truly carbon-retentive displacement of fossil petroleum by renewables.

Raney-Nickel Cathode:

Preparation of the Ra—Ni cathode uses the Lessard method of trapping nickel-aluminum alloy particles in an electrodeposited nickel matrix. 50 ml of plating solution (213 g of $NiCl_2.6H_2O$, 200 ml of 30% $NH_4OH$, and 30 g of $NH_4Cl$ in 1 liter of deionized water) were mixed with Ni—Al powder (50% Al Basis, 50% Ni Basis purum). A 3×2.5 cm (only 2.5×2.5 cm was exposed to the solution) 314 stainless steel 50 mesh screen cathode and a flat nickel electrode bar were placed oriented in parallel plane in the solution mixture. A total of 2 hours at 375 mA (60 mA $cm^{-2}$) for the deposition constant current electrolysis was applied. The cathode was turned 180° every 30 minutes to ensure even deposition of Raney Nickel particles. The pH of the plating solution was monitored with pH paper after every plating and was maintained at pH 8-10 with $NH_4OH$ solution.

The mass of the Ni—Al deposited could be calculated by weight difference, after subtracting the theoretical amount of plated nickel. Control experiments showed that the nickel plating efficiency in the absence of Ni—Al powder stirring was 95%.

The anode nickel bar surface was found to be crucial to the plating quality. If Ni—Al powder was seen to be adhering to the anode during plating of the cathode, then the nickel anode bar was dipped into 6 M of HCl for 5 minutes and rinsed with deionized water.

Raney-Cobalt Cathode:

A 50:50 (atomic %) mixture of metallic cobalt powder and aluminum powder was mixed by tumbling in a nitrogen atmosphere for 6 hours, placed in a tube furnace purged with ultra-high purity argon gas and heated to 1000° C. at a rate of approximately 1° C./min over 16 hours, then held at 1000° C. for 6 hours. The furnace was then switched off and allowed to cool to room temperature overnight. The flow of the argon gas was maintained at approximately 1 bubble per second in the solution trap. The product alloy Co—Al was ground to powder with a mortar and pestle, and was examined with XRD to verify that the lattice structure agreed with the International Center for Diffraction Data (ICDD) 2009 data base. The Co—Al powder was deposited on the stainless steel using the Raney-nickel electrode preparation procedure.

Devarda's Copper Electrode:

Devarda's Copper precursor was purchased from a commercial vendor (Alfa Aesar), and was ground to powder prior to deposition. Deposition was run as for the Raney-Nickel electrode, using the nickel plating solution.

Cobalt-Phosphate Anode:

The anode is prepared by depositing the cobalt-phosphate (Co—P) at a current density of about 1.15 mA $cm^{-2}$, an approximately optimal value reported for catalyst formation. The anode was prepared separately from the reaction. A stainless steel mesh 8 anode 4.5×12 cm (wire area 39.8%) stainless steel screen rolled into a cone shape and placed in a freshly prepared solution made of 0.5 mM Co $(NO_3)_2.6H_2O$ in 0.1 M pH 7.0 phosphate buffer. A constant current electrolysis to deposit catalyst was carried out at 50 mA using a stainless steel wire as a cathode for at least 3-6 hours prior use in reaction.

Electrocatalytic Hydrogenation Reaction:

The two ECH electrodes are placed in a conventional divided cell (e.g., as illustrated in FIG. 2). Reaction was conducted in the divided cell, in which the compartments were separated by a NAFION 117 membrane. 30 ml of catholyte (0.1 M pH 8.0 borate buffer with 0.5 mM CTAB) and 30 ml of anolyte (0.1 M pH 7.0 phosphate buffer with 0.5 mM $Co(NO_3)_2$) were added to the respective compartments. The filled cell was preheated to 75(±3)° C. in a water bath before a 60-minute pre-electrolysis at 50 mA. Substrate was added immediately after the pre-electrolysis. During the reaction, the cathode compartment was covered with rubber stopper, and the anode compartment was left open to allow oxygen to escape. The anode compartment volume was maintained at approximately at 30 ml by occasional addition of anolyte solution to correct for evaporative losses. 0.25 ml samples were taken from the cathode compartment and saturated with 0.1 g sodium chloride. They were then extracted into 1.0 ml of diethyl ether, which was separated and dried over 0.05 g of oven-dried magnesium sulfate. The extracted samples/ether were analyzed with a 30 m DB-5 column in GC-FID with external references for concentration calibration. 3-methoxycyclohexanol and 4-methoxycyclohexanol were assumed to have the same FID response as 2-methoxycyclohexanol.

To increase solubility of the organic substrates and serve as a cathode surface activating agent, the cationic surfactant CTAB is included in the catholyte at 0.5 mM, a concentration chosen via brief optimization. In the control experiment, this additive improves current efficiency. One proposed mechanism is that by making the cathode surface hydrophobic, the surfactant increases the local substrate concentration. It is also possible that by slowing $H_3O^+$ access current-wasting $H_2$ formation is inhibited.

Results:

When guaiacol is subjected to galvanostatic ECH, the first step is methoxy group cleavage, followed by hydrogenation of the resulting phenol to cyclohexanol. Only traces of 2-methoxycyclohexanol, the direct aromatic ring hydrogenation product, are seen. This excellent selectivity for deoxygenation as the first step appears promising for bio-oil energy upgrading.

Figure 4:
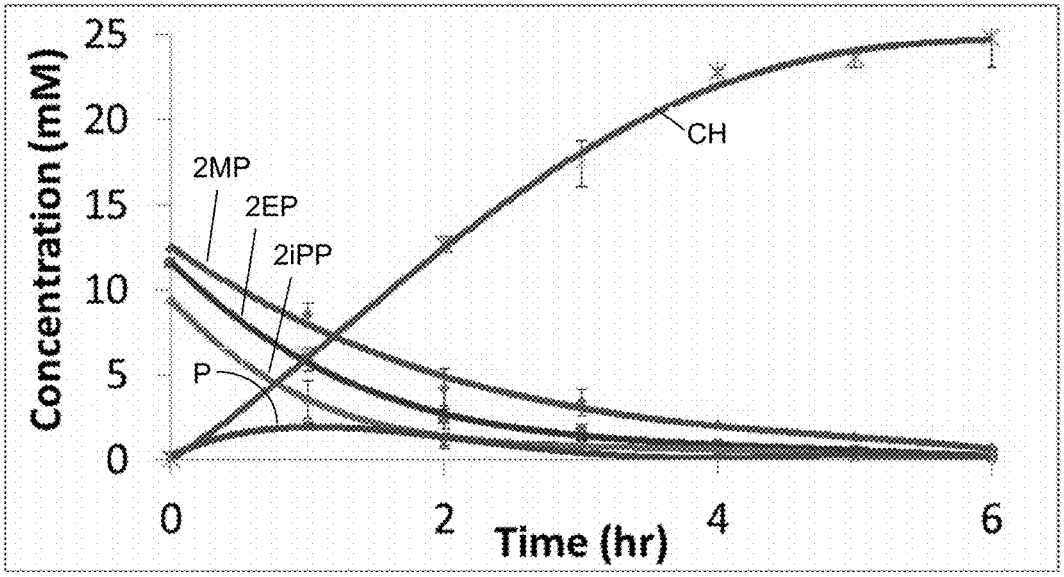
FIG. 4 is a concentration time series for ECH reaction according to the disclosure of a 1:1:1 mixture of 2-methoxyphenol (~~~; 2 MP), 2-ethoxyphenol (~~~; 2EP), and 2-isopropoxyphenol (~~~; 2iPP) undergoes electrocatalytic hydrogenation (ECH) under the same condition described in table 1. All three reactants form a common intermediate, phenol (~~~; P), which is further hydrogenated to cyclohexanol (~~~; CH). Only traces of the alkoxycyclohexanol products of direct hydrogenation were detected.

In addition to guaiacol (2-methoxyphenol), several additional alkoxyphenols were subjected to ECH with results as shown in Table 1 below. Quantum chemical simulations of benzene, phenol, and anisole adsorption on Ni find the aryl ring lying flat on the catalyst surface, and suggest that the —OR groups sterically hinder binding. Such hindrance might be enhanced by bulky sidechains, so the reactivity of the ethyl and isopropyl ether analogues of guaiacol were examined. Consistent with a small steric destabilization effect, the cleavage rate was found to slightly increase with increasing alkoxy group size, as shown in FIG. 4.

TABLE 1

ECH of alkoxyphenols to cyclohexanol

| | Starting Alkoxyphenol Material | | | | |
|---|---|---|---|---|---|
| Reaction Product | 2-MeO | 2-EtO | 2-iPrO | 3-MeO | 4-MeO |
| Unreacted Starting Material | 1.2 | 1.9 | 4.7 | 11.2 | Traces |
| Phenol | — | — | 1.3 | 0.7 | Traces |
| Alkoxy cyclohexanol | Traces[a] | — | — | 37.0[b] | 48.1[a] |
| Cyclohexanol | 89.1 | 98.8 | 85.2 | 46.5 | 44.6 |

TABLE 1-continued

ECH of alkoxyphenols to cyclohexanol

| | Starting Alkoxyphenol Material | | | | |
|---|---|---|---|---|---|
| Reaction Product | 2-MeO | 2-EtO | 2-iPrO | 3-MeO | 4-MeO |
| Mass Balance | 90.3 | 100.7 | 91.2 | 95.4 | 92.7 |
| Current Efficiency (%) | 26 | 22.7 | 22.6 | 17.9 | 18.8 |

Notes:

Values are percentages relative to starting material concentration, 11.3 ± 0.8 mM as determined by gas chromatography. Reductions employed a Raney-Nickel cathode, and a stainless steel anode coated with cobalt phosphate catalyst. MeO, EtO, and iPrO correspond to the indicated methoxy-, ethoxy-, and isopropoxy-substituted phenol, respectively.

[a]Cis and trans peaks are in equal amounts.

[b]Only a single peak was observed by GC.

Figure 5:
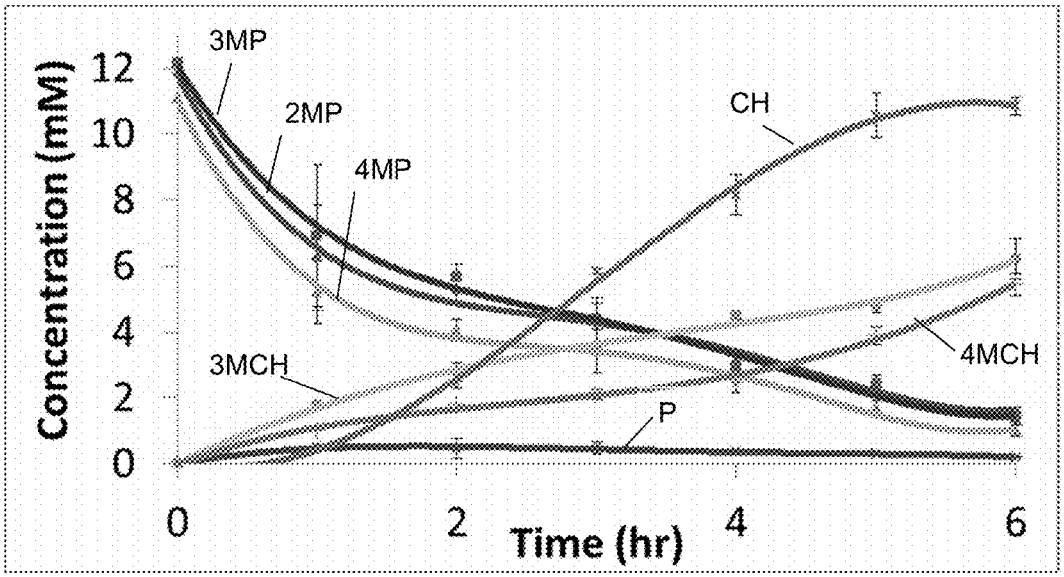
FIG. 5 is a concentration time series for ECH reaction according to the disclosure of a 1:1:1 mixture of 2-methoxyphenol (~~~; 2 MP), 3-methoxyphenol (~~~; 3 MP), and 4-methoxyphenol (~~~; 4 MP) undergoing ECH as above. Formation of 3-methoxycyclohexanol (~~~; 3MCH) and 4-methoxycyclohexanol (~~~; 4MCH) is observable along with cyclohexanol (~~~; CH) as product and phenol (~~~; P) as intermediate. Curves are polynomial fits included to guide the eye.

The guaiacol isomers 3- and 4-methoxyphenol were also subjected to the above reduction conditions and produced cyclohexanol as the major product (FIG. 5). Observable quantities of 3- and 4-methoxycyclohexanol, the direct aromatic hydrogenation products, were also observed. Individual trial results, shown in Table 1, found that alkoxy group cleavage is favored by closer proximity to the phenolic hydroxyl group.

Figure 6:
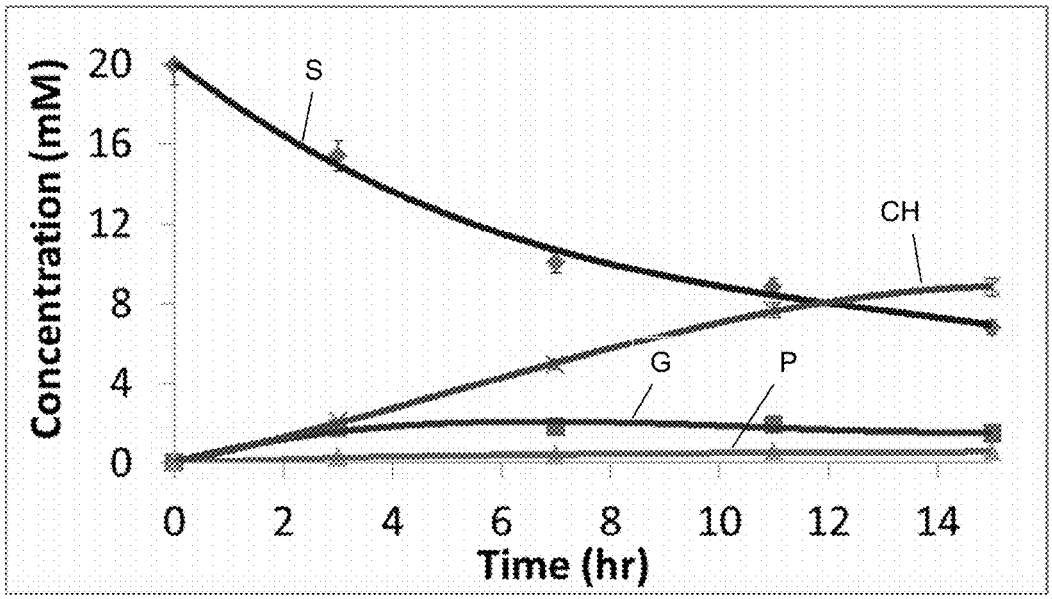
FIG. 6 is a concentration time series for ECH reaction according to the disclosure of 20 mM of syringol (~~~; S) in pH 8.0 buffer at 75±3° C. and 50 mA. Guaiacol (~~~; G), phenol (~~~; P) and cyclohexanol (~~~; CH) are the only products seen.

Like guaiacol, syringol (2,6-dimethoxyphenol) underwent electrocatalytic demethoxylation, but at a slower rate slower (FIG. 6). The guaiacol formed only built up to a small degree, and only traces were seen of the phenol intermediate en route to the cyclohexanol final product.

Current efficiencies (C.E. %) of about 40-50% were found for ECH of all monoalkoxyphenols as shown in Table 1. The bulkier aryl ethers had slightly lower C.E. % and syringol was even lower; perhaps its electron rich arene ring is less susceptible to reduction than those of the monoethers. The low initial C.E. % seen in Table 2 below suggests that syringol undergoes slow mono-demethoxylation to become guaiacol, which is subsequently converted rapidly to phenol and on to cyclohexanol.

TABLE 2

Current efficiency (%) of mixed alkoxyphenols ECH

| | 1 hr | 3 hrs | 5 hrs | 11 hrs | 15 hrs |
|---|---|---|---|---|---|
| Trial A | 77.8 | 69.8 | 57.2 | — | — |
| Trial B | 33.5 | 42.2 | 42.7 | — | — |
| Syringol | 3.2 | 13.2 | 11.0 | 11.7 | 9.7 |

Notes:

Trial A. 1:1:1 mixture of 2-methoxy-, 2-ethoxy- and 2-isopropoxyphenols.

Trial B. 1:1:1 mixture of 2-methoxy-, 3-methoxy-, and 4-methoxyphenols.

In further studies, Raney Cobalt (Ra—Co) and Devarda copper, skeletal metals other than Raney Nickel, were examined as cathodic catalysts. Cobalt-aluminum and Devarda copper (copper zinc aluminum) electrodes were also prepared using the same method as for the Ra—Ni. Only Ra—Co formed observable traces of phenol and cyclohexanol after prolonged reaction time, as expected based on Ra—Co's previously noted lower reactivity compared to Ra—Ni. Importantly, control experiments showed that a plain nickel bar electrode completely failed to reduce guaiacol or phenol. Moreover, while the ruthenium/carbon cloth electrocatalyst described in WO 2013/134220 does achieve demethoxylation, it is much less selective for the ether cleavage. Together, these results indicate that both demethoxylation and hydrogenations require the highly active skeletal nickel.

The anode's cobalt-phosphate water oxidation catalyst provides protons for the cathodic reduction process and prevents corrosion. The cobalt-phosphate system served through a typical 6-hour reaction and a 16-hour syringol trial with no signs of degradation. Also, though NAFION is known to transport cations, no cobalt was detected by EDX on the used Ra—Ni cathode. On the other hand, the Ra—Ni cathodes were found to lose their catalytic hydrogenolysis activity over longer reaction runs, as evidenced by the general declines of C.E. % in Table 2.

Summary:

A mild electrocatalytic deoxygenation/hydrogenation process for reduction of lignin model compounds is described in a simple, low-cost system that avoids the use of precious metal or costly molecular catalysts. Remarkably, instead of arene reduction, the first event in ECH of alkoxyphenols is the cleavage of the aryl-OR ether bond. This scheme opens a new way to maximize yields from biomass-based feedstocks via carbon-retentive energy upgrading using renewable electricity. In turn, it represents a strategy for buffering demand-mismatched production of solar or wind energy by storing it in a fungible chemical form. To optimize efficiency and working lifetime of the system, areas of ongoing development include improvements in cell design, energy and current efficiency, and cathodic electrocatalyst stability. The organic chemical transformations described here also have synthetic potential.

Because other modifications and changes varied to fit particular operating requirements and environments will be apparent to those skilled in the art, the disclosure is not considered limited to the example chosen for purposes of illustration, and covers all changes and modifications which do not constitute departures from the true spirit and scope of this disclosure.

Accordingly, the foregoing description is given for clearness of understanding only, and no unnecessary limitations should be understood therefrom, as modifications within the scope of the disclosure may be apparent to those having ordinary skill in the art.

All patents, patent applications, government publications, government regulations, and literature references cited in this specification are hereby incorporated herein by reference in their entirety. In case of conflict, the present description, including definitions, will control.

Throughout the specification, where the compositions, processes, or apparatus are described as including components, steps, or materials, it is contemplated that the compositions, processes, or apparatus can also comprise, consist essentially of, or consist of, any combination of the recited components or materials, unless described otherwise. Component concentrations can be expressed in terms of weight concentrations, unless specifically indicated otherwise. Combinations of components are contemplated to include homogeneous and/or heterogeneous mixtures, as would be understood by a person of ordinary skill in the art in view of the foregoing disclosure.

REFERENCES

1. Bui, V. N.; Laurenti, D.; Afanasiev, P.; Geantet, C. Applied Catalysis B: Environmental 2011, 101, 239.
2. Czernik, S.; Bridgwater, A. V. Energy Fuels 2004, 18, 590.
3. Furimsky, E. Appl. Catal., A 2000, 199, 147.
4. Elliott, D. C. Energy Fuels 2007, 21, 1792.
5. Mortensen, P. M.; Grunwaldt, J. D.; Jensen, P. A.; Knudsen, K. G.; Jensen, A. D. Appl. Catal., A 2011, 407, 1.
6. Zhao, C.; Kou, Y.; Lemonidou, A. A.; Li, X.; Lercher, J. A. Angew. Chem. 2009, 121, 4047.
7. Bridgwater, A. V. Biomass and Bioenergy 2012, 38, 68.
8. Wildschut, J.; Mahfud, F. H.; Venderbosch, R. H.; Heeres, H. J. Ind. Eng. Chem. Res. 2009, 48, 10324.
9. Choudhary, T. V.; Phillips, C. B. Applied Catalysis A: General 2011, 397, 1.
10. Elliott, D. C.; Hart, T. R. Energy Fuels 2008, 23, 631.
11. Zhao, C.; Kou, Y.; Lemonidou, A. A.; Li, X.; Lercher, J. A. Chem. Commun. 2010, 46, 412.
12. Sergeev, A. G.; Hartwig, J. F. Science 2011, 332, 439.
13. Kelley, P.; Lin, S.; Edouard, G.; Day, M. W.; Agapie, T. J. Am. Chem. Soc. 2012, 134, 5480.
14. Tobisu, M.; Chatani, N. ChemCatChem 2011, 3, 1410.
15. Chapuzet, J. M.; Lasia, A.; Lessard, J. Electrocatalysis; Wiley-VCH: New York, 1998.
16. Kanan, M. W.; Nocera, D. G. Science 2008, 321, 1072.
17. Augustine, R. L. Heterogeneous Catalysis for the Synthetic Chemist; Marvel Dekker, Inc.: New York, 1995.
18. Robin, D.; Comtois, M.; Martel, A.; Lemieux, R.; Cheong, A. K.; Belot, G.; Lessard, J. Can. J. Chem. 1990, 68, 1218.
19. Dabo, P.; Cyr, A.; Lessard, J.; Brossard, L.; Ménard, H. Can. J. Chem. 1999, 77, 1225.
20. Mandavi, B.; Lafrance, A.; Martel, A.; Lessard, J.; Me'Nard, H.; Brossard, L. J. Appl. Electrochem. 1997, 27, 605.
21. Cyr, A.; Chiltz, F.; Jeanson, P.; Martel, A.; Brossard, L.; Lessard, J.; Ménard, H. Can. J. Chem. 2000, 78, 307.
22. Belot, G.; Desjardins, S.; Lessard, J. Tetrahedron Lett. 1984, 25, 5347.
23. Ilikti, H.; Rekik, N.; Thomalla, M. J. Appl. Electrochem. 2002, 32, 603.
24. Ilikti, H.; Rekik, N.; Thomalla, M. J. Appl. Electrochem. 2004, 34, 127.
25. Chambrion, P.; Roger, L.; Lessard, J.; Béraud, V.; Mailhot, J.; Thomalla, M. Can. J. Chem. 1995, 73, 804.

What is claimed is:

1. A process for performing at least one of electrocatalytic hydrogenation (ECH) and electrocatalytic hydrodeoxygenation (ECHDO) of an organic substrate, the process comprising:

(a) providing a reaction mixture comprising (i) water in an amount of at least 25 wt. % relative to the reaction mixture and (ii) an organic reactant comprising one or more functional groups selected from the group consisting of carbonyl carbon-oxygen double bonds, aromatic double bonds, ethylenic carbon-carbon double bonds, acetylenic carbon-carbon triple bonds, hydroxyl carbon-oxygen single bonds, ether carbon-oxygen single bonds, and combinations thereof;

(b) contacting the reaction mixture with a first electrode and a catalytic composition comprising a skeletal metal catalyst capable of catalyzing at least one of electrocatalytic hydrogenation (ECH) and electrocatalytic hydrodeoxygenation (ECHDO);

(c) electrically contacting the reaction mixture with a second electrode; and (d) applying an electrical potential between the first electrode and the second electrode to provide an electrical current therebetween and through the reaction mixture, thereby performing at least one of an ECH reaction and an ECHDO reaction to reduce or deoxygenate at least one of the functional groups of the organic reactant and to form at least one of (i) an ECH reaction product thereof and (ii) an ECHDO reaction product thereof;

wherein the reaction mixture has a pH value ranging from 4 to 11 when applying the electrical potential to form the reaction product, wherein the reaction mixture is free from added water-miscible organic solvents, wherein the reaction mixture comprises a plurality of the organic reactants, the plurality being selected from the group consisting of a multicomponent bio-oil, a multicomponent bio-oil fraction, a plurality of bio-oil components, a multicomponent lignin depolymerization product, a multicomponent lignin depolymerization product fraction, a plurality of lignin depolymerization product components, and combinations thereof, and wherein the organic reactant has a conversion of at least 80% as a result the at least one of the ECH reaction and the ECHDO reaction in part (d).

2. The process of claim 1, wherein the reaction mixture has an initial pH value ranging from 4 to 10 and is maintained in the range from 4 to 10 during the application of the electrical potential to form the reaction product.

3. The process of claim 1, wherein the reaction mixture further comprises a pH buffer to maintain the pH value of the reaction mixture in a selected range during the application of the electrical potential to form the reaction product.

4. The process of claim 1, wherein the metal of the skeletal metal catalyst comprises at least one of Ni and a Ni-containing alloy.

5. The process of claim 1, wherein the skeletal metal catalyst comprises an alkaline leaching product of an alloy comprising (i) aluminum and (ii) nickel as the metal of the skeletal metal catalyst.

6. The process of claim 1, wherein the skeletal metal catalyst has a microporous structure with a specific BET surface area ranging from 5 $m^2/g$ to 100 $m^2/g$.

7. The process of claim 1, wherein the catalytic composition is immobilized on the first electrode.

8. The process of claim 7, wherein the catalyst composition comprises an alkaline leaching product of a composite material comprising (i) a metal matrix and (ii) an alloy comprising (A) aluminum and (B) the metal of the skeletal metal catalyst.

9. The process of claim 1, wherein the catalyst composition is capable of catalyzing at least one of (i) ECH of unsaturated carbon-carbon bonds in an organic substrate, (ii) ECH of carbon-oxygen double bonds in an organic substrate, and (iii) ECHDO of carbon-oxygen single bonds in an organic substrate.

10. The process of claim 1, wherein the organic reactant comprises the aromatic double bonds and at least 80% of the aromatic double bonds are hydrogenated via ECH in the ECH reaction product.

11. The process of claim 1, wherein the organic reactant comprises the ether carbon-oxygen single bonds and at least 80% of the ether carbon-oxygen single bonds are cleaved via ECHDO in the ECHDO reaction product.

12. The process of claim 1, wherein the aromatic double bonds are present and in a functional group selected from the group consisting of benzenes, phenols, furans, pyridines, pyrazines, imidazoles, pyrazoles, oxazoles, thiophenes, naphthalenes, higher fused aromatics, and combinations thereof.

13. The process of claim 1, wherein the functional group comprises an aromatic CH group, and the corresponding ECH reaction product comprises a $CH_2$ group.

14. The process of claim 1, wherein the functional group comprises an ether $R_1$—O—$R_2$ group, and the corresponding ECH or ECHDO reaction products comprise one or more of a $R_1H$, $R_2OH$, $R_1OH$, and $R_2H$, where $R_1$ and $R_2$ are substituents containing from 1 to 10 carbon atoms.

15. The process of claim 1, wherein:

(i) the functional group comprises an ether $R_1$—O—$R_2$ group, (ii) the corresponding ECH or ECHDO reaction products comprise one or more of a $R_1H$, $R_2OH$, $R_1OH$, and $R_2H$, (iii) $R_1$ is a substituted or unsubstituted aromatic or heteroaromatic substituent containing 3 to 20 carbon atoms, and (iv) $R_2$ is a substituted or unsubstituted alkyl substituent containing from 1 to 10 carbon atoms.

16. The process of claim 1, wherein:

(i) the functional group comprises an ether $R_1$—O—$R_2$ group, (ii) the corresponding ECH or ECHDO reaction products comprise one or more of $R_1$*H and $R_2OH$, (iii) $R_1$ is a substituted or unsubstituted aromatic or heteroaromatic substituent containing 3 to 20 carbon atoms, (iv) $R_1$* is a hydrogenated analog of $R_1$, and (v) $R_2$ is a substituted or unsubstituted alkyl substituent containing from 1 to 10 carbon atoms.

17. The process of claim 1, wherein the reaction mixture comprises a plurality of the organic reactants, the plurality being selected from the group consisting of a multicomponent bio-oil, a multicomponent bio-oil fraction, a plurality of bio-oil components, and combinations thereof.

18. The process of claim 1, wherein the reaction mixture comprises a plurality of the organic reactants, the plurality being selected from the group consisting of a multicomponent lignin depolymerization product, a multicomponent lignin depolymerization product fraction, a plurality of lignin depolymerization product components, and combinations thereof.

19. The process of claim 1, further comprising:

(e) recovering or separating the reaction product from the reaction mixture.

20. The process of claim 1, comprising performing the ECH or ECHDO reaction at a temperature ranging from 0° C. to 100° C. and at a pressure ranging from 0.8 atm to 1.2 atm.

21. The process of claim 1, wherein the reaction mixture further comprises a surfactant.

22. The process of claim 1, wherein the second electrode comprises cobalt(III) phosphate.

23. A process for performing at least one of electrocatalytic hydrogenation (ECH) and electrocatalytic hydrodeoxygenation (ECHDO) of an organic substrate, the process comprising:

(a) providing a reaction mixture comprising (i) water in an amount of at least 15 wt. % relative to the reaction mixture and (ii) a plurality of organic reactants, wherein:

the plurality of organic reactants is selected from the group consisting of a multicomponent bio-oil, a multicomponent bio-oil fraction, a plurality of bio-oil components, and combinations thereof, the organic reactants collectively comprise one or more functional groups selected from the group consisting of carbonyl carbon-oxygen double bonds, aromatic double bonds, ethylenic carbon-carbon double bonds, acetylenic carbon-carbon triple bonds, hydroxyl carbon-oxygen single bonds, ether carbon-oxygen single bonds, and combinations thereof; and the reaction mixture is free from added water-miscible organic solvents;

(b) contacting the reaction mixture with a first electrode and a catalytic composition comprising a skeletal metal catalyst capable of catalyzing at least one of electrocatalytic hydrogenation (ECH) and electrocatalytic hydrodeoxygenation (ECHDO);

(c) electrically contacting the reaction mixture with a second electrode; and (d) applying an electrical potential between the first electrode and the second electrode to provide an electrical current therebetween and through the reaction mixture, thereby performing at least one of an ECH reaction and an ECHDO reaction to reduce or deoxygenate at least one of the functional groups of the organic reactants and to form at least one of (i) an ECH reaction product thereof and (ii) an ECHDO reaction product thereof, wherein the organic reactants have a conversion of at least 80% as a result the at least one of the ECH reaction and the ECHDO reaction.

24. The process of claim 23, wherein the bio-oil is a reaction product produced from fast pyrolysis of biomass.

25. The process of claim 23, wherein the water is present in the reaction mixture in an amount of at least 25 wt. % relative to the reaction mixture.

26. The process of claim 23, wherein the reaction mixture comprises the multicomponent bio-oil fraction, the fraction having been obtained by extraction of bio-oil using a solvent comprising one or more of water, diethyl ether, ethyl acetate, dichloromethane, chloroform, toluene, and hexane.

27. The process of claim 23, wherein the reaction mixture comprises a plurality of bio-oil pyrolysis products selected from the group consisting of acetol, hydroxyacetaldehyde, glyoxal, formaldehyde, acetic acid, phenol, guaiacol, syringol, levoglucosan, furfural, glucose, xylose, substituted derivatives thereof, and combinations thereof.

28. The process of claim 23, wherein the reaction product comprises one or more of ethylene glycol, propylene glycol, cyclohexanol, furfuryl alcohol, and methanol.

29. The process of claim 23, wherein the pH value of the reaction mixture ranges from 6 to 9.

30. The process of claim 23, wherein the reaction mixture further comprises a pH buffer to maintain the pH value of the reaction mixture in a selected range during the application of the electrical potential to form the reaction product.

* * * * *